US007798484B2

(12) United States Patent
Takito et al.

(10) Patent No.: US 7,798,484 B2
(45) Date of Patent: Sep. 21, 2010

(54) SHEET FEEDER

(75) Inventors: Koji Takito, Nissin (JP); Singo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 604 days.

(21) Appl. No.: 11/128,416

(22) Filed: May 13, 2005

(65) Prior Publication Data

US 2005/0264636 A1 Dec. 1, 2005

(30) Foreign Application Priority Data

May 14, 2004 (JP) ..... P2004-145192

(51) Int. Cl.
*B65H 3/52* (2006.01)
*B65H 5/22* (2006.01)
*B65H 5/00* (2006.01)

(52) U.S. Cl. ..... 271/124; 271/10.03; 271/4.03

(58) Field of Classification Search ..... 271/124, 271/8.1, 10.03, 10.04, 4.02, 4.03, 31.1, 117, 271/167
See application file for complete search history.

(56) References Cited

U.S. PATENT DOCUMENTS 4,958,824 A * 9/1990 Willits et al. ..... 271/11
5,273,269 A * 12/1993 Iwanaga ..... 271/124
5,277,417 A * 1/1994 Moritake et al. ..... 271/121
5,918,873 A * 7/1999 Saito et al. ..... 271/10.11
5,927,703 A 7/1999 Endo
5,971,390 A * 10/1999 Caspar et al. ..... 271/121
6,042,104 A * 3/2000 Nishikori et al. ..... 271/121
6,116,589 A * 9/2000 Bortolotti ..... 271/121
6,382,621 B1 * 5/2002 Inoue et al. ..... 271/120
7,108,257 B2 9/2006 Shiohara et al.
7,220,093 B2 * 5/2007 Overman et al. ..... 414/796.9
2003/0085506 A1 * 5/2003 Kubo ..... 271/117
2003/0137094 A1 * 7/2003 Hsieh ..... 271/121
2003/0184003 A1 * 10/2003 Asada et al. ..... 271/121
2003/0184004 A1 10/2003 Shiohara et al.

(Continued)

FOREIGN PATENT DOCUMENTS

JP 60218242 * 10/1985

(Continued)

OTHER PUBLICATIONS

Office Action in corresponding Japanese Application No. JP 2004-145192.

*Primary Examiner*—Patrick Mackey
*Assistant Examiner*—Patrick Cicchino
(74) *Attorney, Agent, or Firm*—Banner & Witcoff, Ltd

(57) ABSTRACT

A sheet feeder including: a storing unit that stores a plurality of sheets of recording medium; a retaining unit provided at an edge of the recording medium that is stored in the storing unit, and having an inclined surface that is inclined to a surface of the recording medium and a protrusion member that retains the edge of the recording medium in a state being protruded from the inclined surface to be in contact with the edge of the recording medium; a sheet feeding mechanism that conveys the recording medium stacked in the storing unit toward the retaining unit and feeds the recording medium; and a protrusion amount adjusting mechanism that adjusts a protrusion amount of the protrusion member from the inclined surface.

19 Claims, 14 Drawing Sheets

U.S. PATENT DOCUMENTS

2004/0004321 A1 * 1/2004 Uwagaki et al. ..... 271/117

FOREIGN PATENT DOCUMENTS

| | | |
|---|---|---|
| JP | 04-016748 | 1/1992 |
| JP | 4-16748 | 2/1992 |
| JP | 5238576 | 9/1993 |
| JP | 6115740 | 4/1994 |
| JP | 9235033 | 9/1997 |
| JP | 11143154 | 5/1999 |
| JP | 2000327156 | 11/2000 |
| JP | 2003292183 | 10/2003 |

* cited by examiner

SHEET FEEDER

BACKGROUND OF THE INVENTION

1. Field of the Invention

The present invention relates to a sheet feeder provided in an apparatus such as a printer.

2. Description of the Related Art

An apparatus configured so that paper feeding is performed in such a manner that sheets of recording paper P being stacked are conveyed toward an inclined surface that is inclined to a surface of the recording paper and extracted (separated) one by one by friction between an end portion of each sheet of recording paper and the inclined surface and between the end portion of each sheet of recording paper and a protrusion member protruded from the inclined surface has been heretofore used as a sheet feeder for providing in an apparatus such as a printer.

Configuration in which a member having a friction coefficient higher than that of a member constituting the inclined surface (inclined separation surface) is used as the protrusion member (separation member) in this configuration so that the protrusion member supported by a plate spring (elastic supporting member) made of metal is protruded from the inclined surface has been proposed recently (see JP-A-2003-292183).

According to such configuration, because the plate spring made of metal is little affected by the environmental change (temperature change and humidity change) in use of the sheet feeder, there can be obtained an advantage that sheets of recording paper can be extracted stably regardless of the environment in use.

SUMMARY OF THE INVENTION

In the aforementioned configuration, the protrusion member is made of a resin material or the like having a high friction coefficient but abrasion of a contact portion caused by repetition of contact between the protrusion member and each sheet of recording paper at the time of paper feeding is unavoidable if the protrusion member is made of such a resin material. When the protrusion member is worn out, the protrusion member and each sheet of recording paper cannot be in adequate contact with each other. Accordingly, there is a possibility that sheets of recording paper cannot be extracted one by one exactly.

In such a case, the paper feeding function of the sheet feeder can be recovered if the protrusion member is exchanged for a new one but the sheet feeder lacks user friendliness because the protrusion member is generally attached to a position unexchangeable to a user in terms of the structure of the sheet feeder so that the user must ask an expert repairperson or the like the repair service to recover the paper feeding function.

The invention is to solve the problem and one of objects thereof is to provide a sheet feeder having a paper feeding function capable of being recovered easily.

According to one aspect of the invention, there is provided a sheet feeder including: a storing unit that stores a plurality of sheets of recording medium; a retaining unit provided at an edge of the recording medium that is stored in the storing unit, and having an inclined surface that is inclined to a surface of the recording medium and a protrusion member that retains the edge of the recording medium in a state being protruded from the inclined surface to be in contact with the edge of the recording medium; a sheet feeding mechanism that conveys the recording medium stacked in the storing unit toward the retaining unit and feeds the recording medium while extracting the recording medium one by one from the storing unit by friction between the edge of the recording medium and the inclined surface and by friction between the edge of the recording medium and the protrusion member; and a protrusion amount adjusting mechanism that adjusts a protrusion amount of the protrusion member from the inclined surface.

BRIEF DESCRIPTION OF THE DRAWINGS

These and other objects and advantages of the present invention will become more fully apparent from the following detailed description taken with the accompanying drawings, in which:

FIGS. 3A-3D are sectional views showing a retaining unit, wherein FIGS. 3A and 3C are sectional views taken along a plane perpendicular to a paper feeding direction, and wherein FIGS. 3B and 3D are sectional views taken along a plane parallel to the paper feeding direction;

DETAILED DESCRIPTION OF THE PREFERRED EMBODIMENTS

An embodiment of the invention will be described below with reference to the drawings.

First Embodiment

Figure 1:
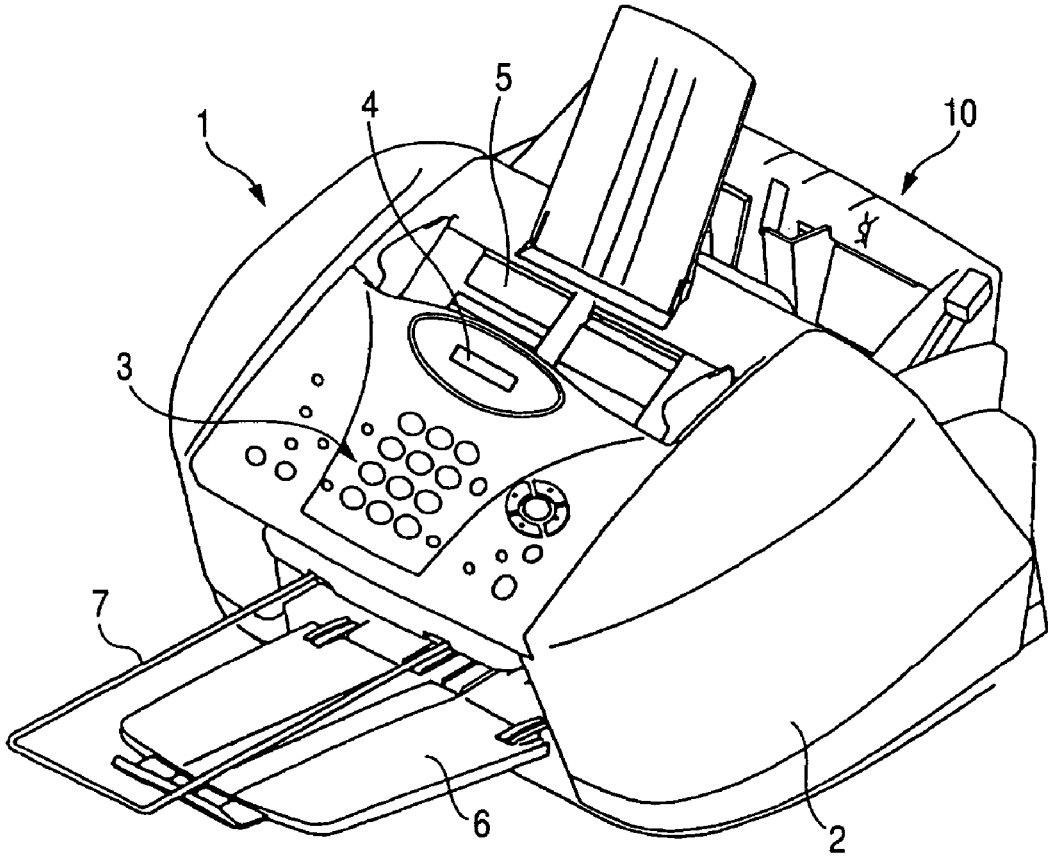
FIG. 1 is a perspective view showing a multi-function device.

A multi-function device 1 is an apparatus having a plurality of functions such as a facsimile function, a printer function, a copying function, and a scanner function. As shown in FIG. 1, the multi-function device 1 includes: a casing 2; an operation panel 3 having various kinds of keys arranged in an upper surface of the casing 2; a display portion 4 having a liquid crystal display arranged on a rear side of the operation panel 3; a document set portion 5 arranged on a rear side of the display portion 4; a recording paper ejection tray 6 arranged on a front side of the casing 2; a reading paper ejection tray 7 arranged above the recording paper ejection tray 6; and a sheet feeder 10 arranged on a rear side of the document set portion 5.

Figure 2:
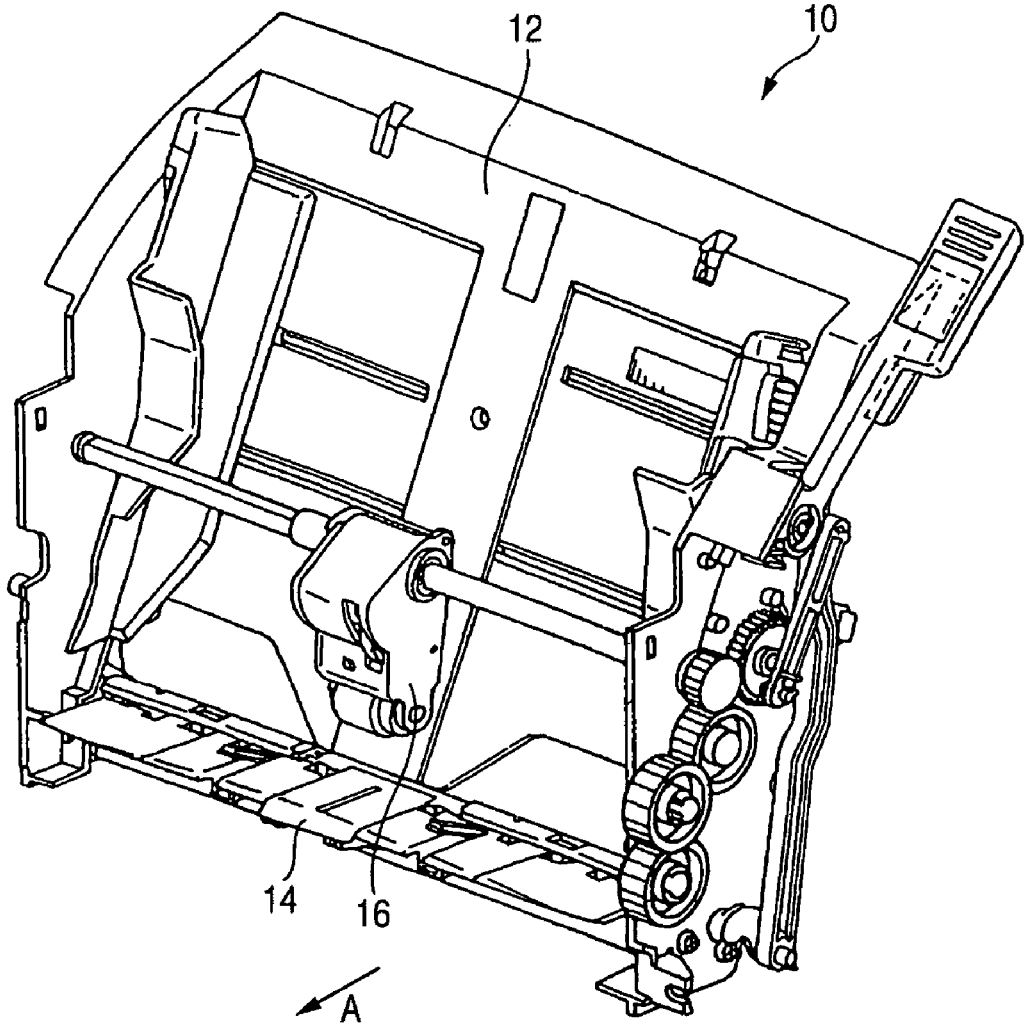
FIG. 2 is a perspective view showing a sheet feeder.

As shown in FIG. 2, the sheet feeder 10 includes: a stacking portion 12 for stacking sheets of recording paper; a retaining unit 14 located on a lower end portion side of the sheets of recording paper stacked in the stacking portion 12; and a paper feed roller unit 16 by which the sheets of recording paper stacked in the stacking portion 12 are conveyed in a paper feeding direction (shown by an arrow A in FIG. 2). The sheet feeder 10 is an apparatus for feeding paper while extracting the sheets of recording paper one by one from the stacking portion 12 by friction between the lower end portion of each sheet of recording paper stacked in the stacking portion 12 and the retaining unit 14. Incidentally, detailed description of the sheet feeder 10 will be omitted because the specific paper-feeding configuration of the sheet feeder 10 is the same as that of a conventional sheet feeder as described in JP-A-2003-292183.

The retaining unit 14 is arranged so that an upper surface 14*a* of the retaining unit 14 is horizontal. Accordingly, the upper surface 14*a* is inclined to a surface of each sheet of recording paper stacked in the stacking portion 12.

Figure 3B:
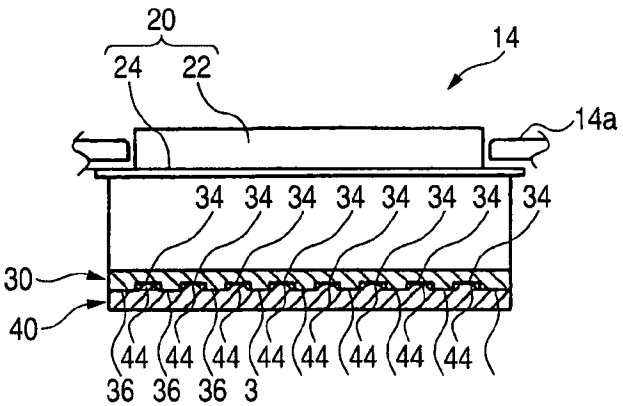
Figure 3D:
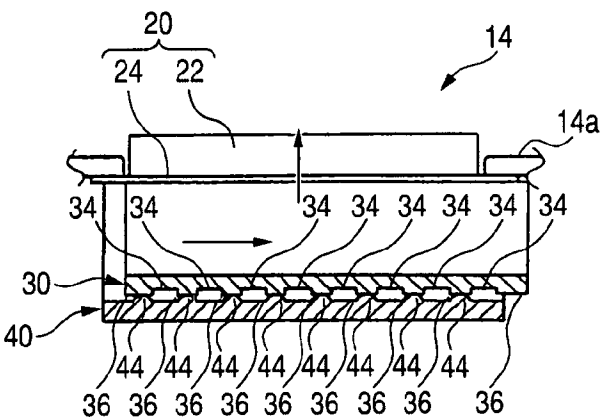
Figure 3A:
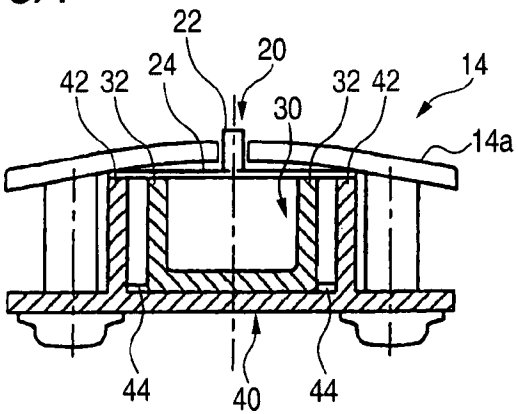
Figure 3C:
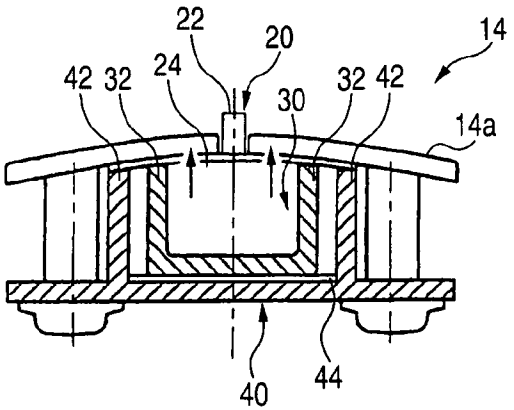

As shown in FIGS. 3A-3D, the retaining unit 14 is provided with: a protrusion member 20 provided so as to protrude from the upper surface 14*a*; a variable pressing portion 30 for pressing the protrusion member 20 from an end portion side buried in the retaining unit 14; and a variable support portion 40 for supporting the variable pressing portion 30. FIGS. 3A and 3C are sectional views of the retaining unit 14 taken along a plane perpendicular to the paper feeding direction. FIGS. 3B and 3D are sectional views of the retaining unit 14 taken along a plane parallel to the paper feeding direction.

The protrusion member 20 in the retaining unit 14 is provided with: a protrusion portion 22 made of a resin and protruding from the upper surface 14*a* of the retaining unit 14; and a plate spring portion 24 made of metal and attached to the protrusion portion 22. The protrusion member 20 is formed so that the protrusion portion 22 is displaced in such a direction that the protrusion portion 22 is protruded/buried from/into the upper surface 14*a* of the retaining unit 14 (in a vertical direction in FIGS. 3A-3D), with elastic deformation of the plate spring portion 24.

The variable pressing portion 30 is provided with: a pair of presser end portions 32 for pressing the plate spring portion 24 of the protrusion member 20 from a lower side; and two kinds of supported surfaces 34 and 36 being different in distance from each presser end portion 32 and being formed in end portions opposite to the presser end portions 32 (i.e., on a side opposite to the side of the presser end portions in a direction in which the presser end portions 32 press the protrusion member 20: the lower end portion in FIGS. 3A to 3D) so as to be arranged along a direction (a left-right direction in FIG. 3A) perpendicular to the paper feeding direction. In the first embodiment, the variable pressing portion 30 is formed so that the first supported surfaces 34 are nearer to the presser end portions 32 than the second supported surfaces 36.

The variable support portion 40 is provided with: a pair of support end portions 42 by which opposite ends of the plate spring portion 24 in the protrusion member 20 (i.e., opposite ends of the plate spring portion 24 in FIG. 3A) are supported from below; and support protrusions 44 formed in positions facing the supported surfaces 34 and 36 of the variable pressing portion 30 so as to be arranged along a direction perpendicular to the paper feeding direction and provided for supporting the variable pressing portion 30 in a state in which each support protrusion 44 comes into contact with any one of the supported surfaces. In an initial state (at the time of shipping from a factory), the support protrusions 44 are in contact with the first supported surfaces 34 of the variable pressing portion 30 (see FIGS. 3A and 3B).

The retaining unit 14 configured thus is formed so that the variable pressing portion 30 slides along the supported surfaces. The variable pressing portion 30 slides in order to change the supported surfaces being in contact with the support protrusions 44 of the variable support portion 40. When the variable pressing portion 30 is slid from a state in which the support protrusions 44 of the variable support portion 40 are in contact with the first supported surfaces 34 to a state in which the support protrusions 44 of the variable support portion 40 are in contact with the second supported surfaces 36, the variable pressing portion 30 is moved up by a distance equivalent to the difference between the height of the first supported surfaces 34 and the height of the second supported surfaces 36 to thereby press up the plate spring portion 24 of the protrusion member 20. Because the protrusion portion 22 is pressed up in accordance with elastic deformation of the plate spring portion 24 pressed up, the protrusion amount of the protrusion portion 22 from the upper surface 14*a* of the retaining unit 14 is changed (see FIGS. 3C and 3D).

Figure 4A:
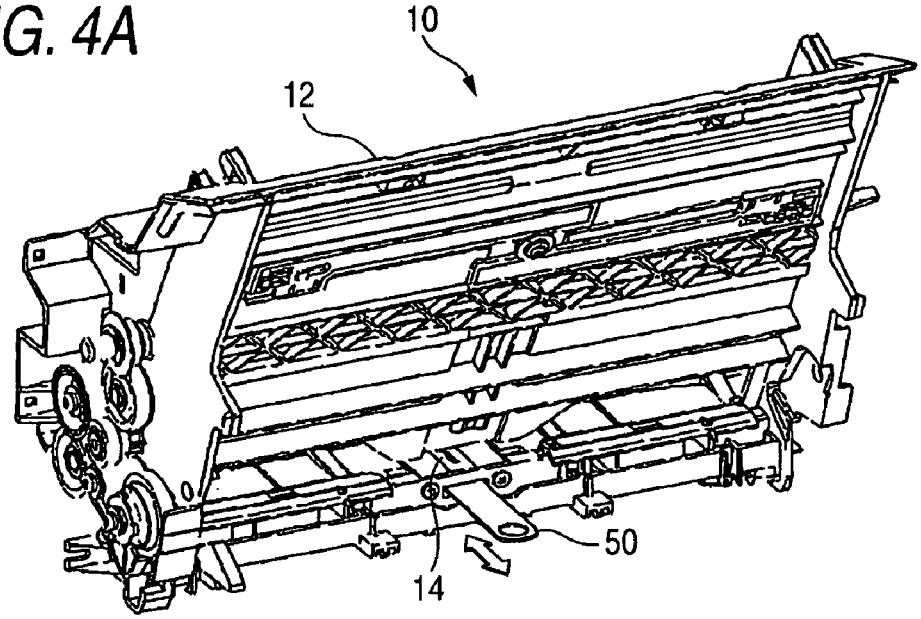
FIGS. 4A-4C are perspective views showing a state in which an operation lever in the sheet feeder is operated.
Figure 4B:
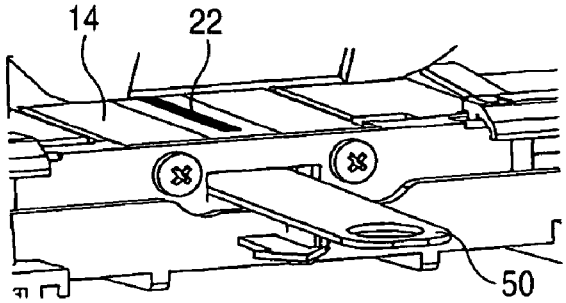
Figure 4C:
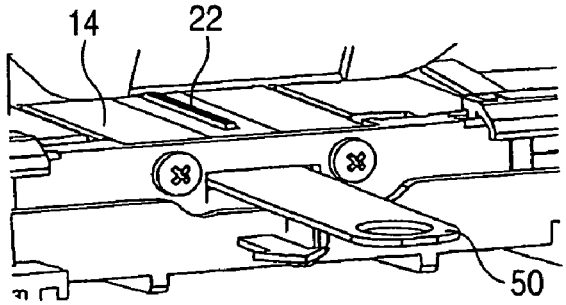

As shown in FIG. 4A, an operation lever 50 extending from the variable pressing portion 30 to the rear of the sheet feeder 10 (the right side in FIGS. 3B and 3D) is attached to the retaining unit 14. The variable pressing portion 30 is configured to be displaced when the operation lever 50 is slid in a direction crossing a casing surface (i.e., stacking portion 12) of the sheet feeder 10 (see FIGS. 4B and 4C). FIG. 4B shows a state before the variable pressing portion 30 is slid. When the operation lever 50 in this state in FIG. 4B is pulled out by a distance equivalent to the distance between adjacent support protrusions 44 in the variable support portion 40 as shown in FIG. 4C (the operation lever 50 in FIG. 4C is pulled out slightly compared with that in FIG. 4B), the protrusion amount of the protrusion portion 22 in the protrusion member 20 increases.

In the first embodiment, the variable support portion 40 is fixedly provided in the retaining unit 14, whereas the variable pressing portion 30 is attached to the operation lever 50 and is displaced in horizontal and vertical directions when the operation lever 50 is operated.

However, the variable support portion 40 may be configured so that the variable pressing portion 30 is provided to be displaceable in vertical direction, whereas the variable support portion 40 is provided to be displaceable in horizontal direction and attached to the operation lever 50 to change the protrusion amount of the protrusion portion 22 in the protrusion member 20.

Figure 5:
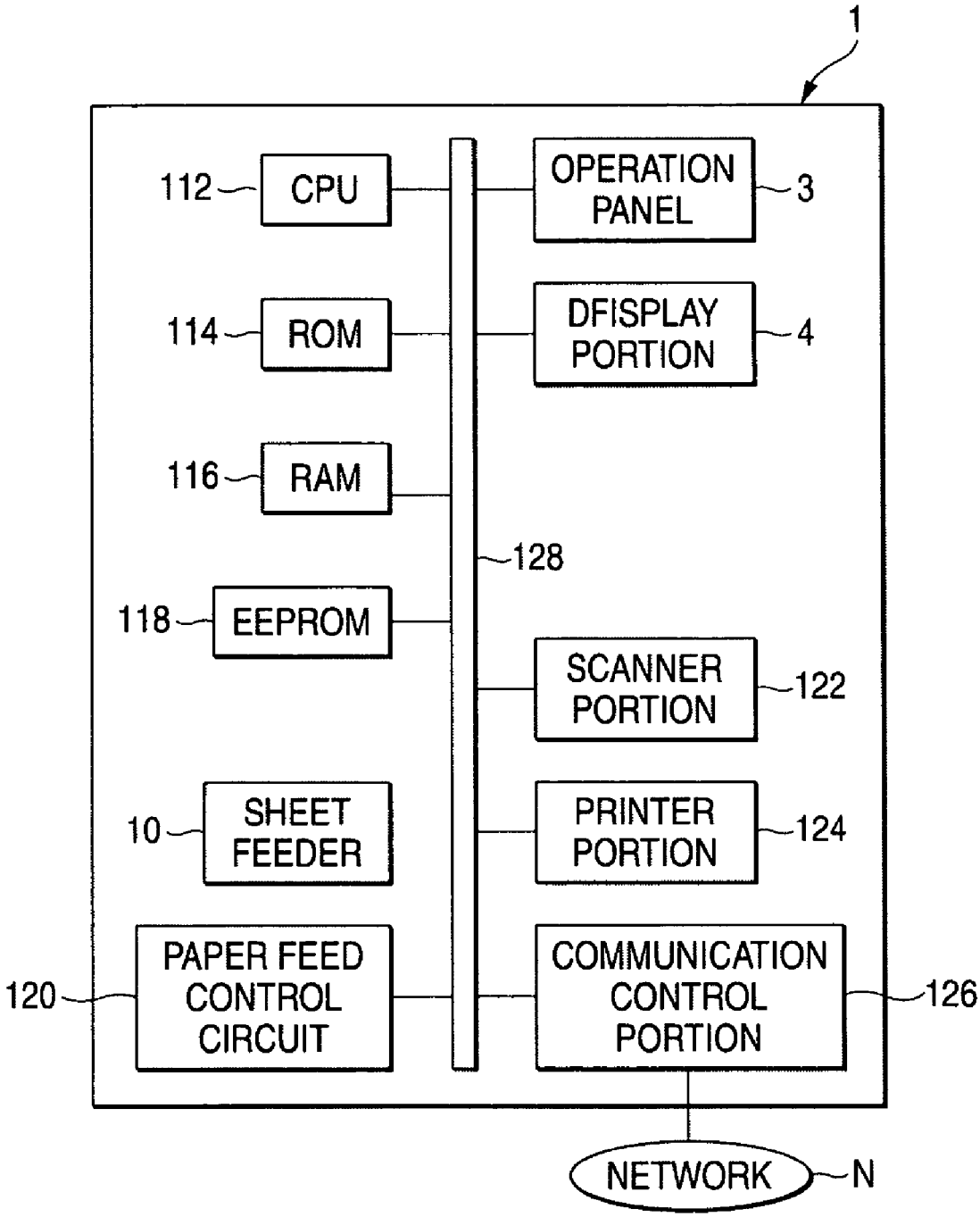
FIG. 5 is a block diagram showing a control system for the multi-function device.

As shown in FIG. 5, in the multi-function device 1, a CPU 112 for controlling the operation of the whole of the multi-function device 1, an ROM 114 for storing processing procedures of the CPU 112 or the like, an RAM 116 for storing processing results of the CPU 112 or the like, an EEPROM (Electrically Erasable Programmable Read-Only Memory) 118 for storing contents etc. of setting for various functions, a paper feed control circuit 120 for controlling the operation of the sheet feeder 10, a scanner portion 122 for reading an image from a sheet of recording paper, a printer portion 124 for forming an image on a sheet of recording paper, a communication control portion 126 for connecting the multi-function device 1 to a communication circuit network N, and so on, are connected to one another by a bus 128 to thereby form a control system.

Change Notification Process in the First Embodiment

A processing procedure of a change notification process which is executed by the CPU 112 whenever the sheet feeder 10 feeds paper will be described below with reference to FIGS. 6 and 7.

First, a variable "Retry" is initialized (the variable "Retry" is set to a value "0") (s110). The variable "Retry" is stored in a predetermined storage area of the RAM 116 as an integrated variable expressing the number of times by which the sheet feeder 10 could not normally convey recording paper continuously.

Next, a determination is made as to whether recording paper is set in the sheet feeder 10 or not (s120). In the first embodiment, the determination as to whether recording paper is set in the sheet feeder 10 or not, is made on the basis of a detection result of a paper detection sensor (not shown) provided in the sheet feeder 10. Incidentally, detailed description of a configuration for making a determination on the basis of the paper detection sensor as to whether recording paper is set in the sheet feeder 10 or not, will be omitted because the configuration is known well.

When a decision is made in the step s120 that recording paper is not set (s120: NO), the sheet feeder 10 is notified that recording paper should be supplemented to the sheet feeder 10 (s130). The step s130 is repeated (s140: NO) until an operation for the completion of setting of recording paper is performed by the operation panel 3. In the step s130, a message "Please set paper" indicating the necessity of supplement of recording paper is displayed on the display portion 4 to thereby perform notification.

Figure 8:
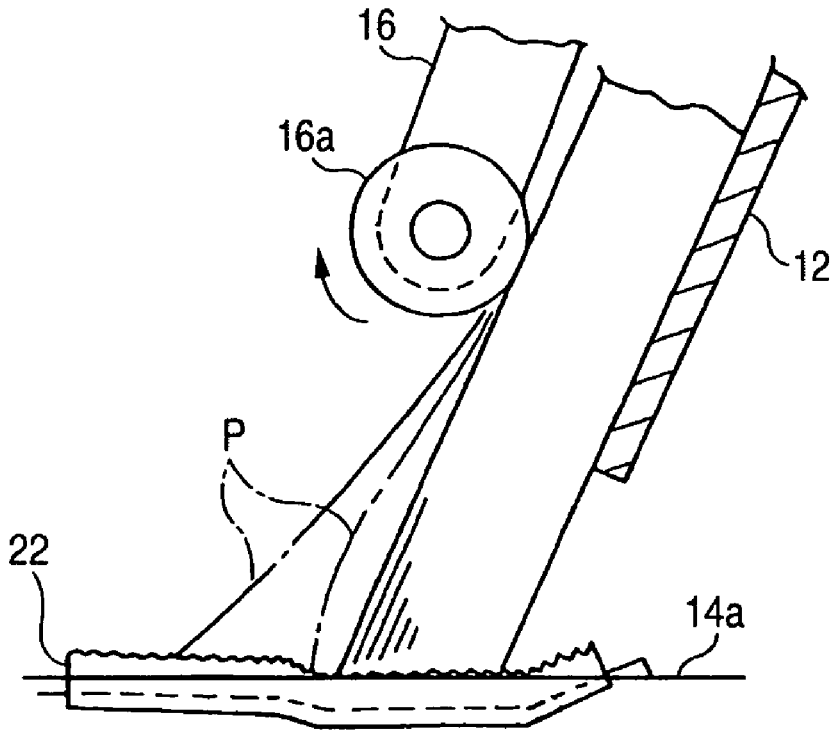
FIG. 8 is a view showing a state in which paper feeding is performed by the sheet feeder.

When the operation for the completion of setting of recording paper is then performed (s140: YES) or when a decision is made in the step s120 that recording paper is set (s120: YES), a paper feeding operation of the sheet feeder 10 is executed through the paper feed control circuit 120 (s150). On this occasion, in the sheet feeder 10, the paper feed roller 16*a* of the paper feed roller unit 16 is rotated as shown in FIG. 8, so that uppermost one P of the sheets of recording paper set in the stacking portion 12 is conveyed in a direction in which the uppermost sheet of recording paper P is pressed against the retaining unit 14. As a result, the sheet of recording paper P is gradually displaced in a direction of conveyance along the protrusion portion 22 while the protrusion portion 22 of the protrusion member 20 is pressed down by a lower end portion of the sheet of recording paper P in accordance with the flexibility of the sheet of recording paper P. After the sheet of recording paper P is displaced along the protrusion portion 22 until the lower end portion of the sheet of recording paper P comes into contact with the upper surface 14*a* of the retaining unit 14, the sheet of recording paper P is conveyed in a direction along the upper surface 14*a*, that is, in the paper feeding direction.

Next, "1" is added to a variable "Total" (a value of the variable "Total" is increased by one) (s160). The variable "Total" is a variable stored in the EEPROM 118 as an integrated variable expressing the number of times by which the sheet feeder 10 has fed paper so far. In initial setting (at the time of shipping from a factory), "0" is set in the variable "Total".

Then, a determination is made as to whether the sheet of recording paper has been conveyed to the printer portion 124 or not (s170). In the first embodiment, when conveyance of the sheet of recording paper can be detected by the paper detection sensor (not shown) provided in the printer portion 124 within a predetermined time after the paper feeding operation of the sheet feeder 10 is executed in the step s150, a decision is made that the sheet of recording paper has been conveyed to the printer portion 124. A state in which a decision is made that the sheet of recording paper has not been conveyed to the printer portion 124 indicates occurrence of a situation (i.e. idle feed) where the sheet of recording paper could not been conveyed though the sheet feeder 10 could be operated.

When a decision is made in the step s170 that the sheet of recording paper has not been conveyed (s170: NO), a determination is made as to whether the variable "Retry" has reached the "maximum retry number L (3 in this embodiment)" (Retry=L) or not (s180). When a decision is made that the variable "Retry" has not reached the maximum retry number L (s180: NO), the variable "Retry" is incremented by 1 (a value of the variable "Retry" is increased by one) (s190) and the current position of this routine goes back to the step s150 to execute the paper feeding operation again.

On the other hand, when a decision is made that the variable "Retry" has reached the maximum retry number L (s170: YES), a variable "Count_A" is incremented by 1 (a value of the variable "Count_A" is increased by one) (s200). The variable "Count_A" is a variable stored in a predetermined storage area of the EEPROM 118, as an integrated variable expressing the number of times in occurrence of multi feed. In initial setting (at the time of shipping from a factory), "0" is set in the variable "Count_A".

Then, a determination is made as to whether the variable "Count_A" has reached a "threshold Ka of the accumulated idle feed number (100 in this embodiment)" (Count_A=Ka) or not (s210).

When a decision is made in the step s210 that the variable "Count_A" has not reached the threshold Ka of the accumulated idle feed number (s210: NO), notification that the paper feed roller unit 16 (paper feed roller 16*a*) of the sheet feeder 10 needs to be cleaned is performed (s220). In this step s220, a message "Clean the paper feed roller" indicating the necessity of cleaning the paper feed roller unit 16 is displayed on the display portion 4 to thereby perform notification. In this manner, in this embodiment, a situation where the number of times (variable "Retry") in continuous occurrence of idle feed has reached the maximum retry number L but the accumulated number of times (variable "Count_A") in occurrence of idle feed is small (i.e., the variable "Count_A" has not reached the threshold Ka) is estimated as accidental occurrence of idle feed caused by dirt etc. deposited on the paper feed roller unit 16, so that notification that the paper feed roller unit 16 needs to be cleaned is performed.

A standby state is given (s240: NO) until an operation for the completion of cleaning of the paper feed roller unit 16 is performed by the operation panel 3 after this notification is made. When this operation is performed (s240: YES), the current position of this routine goes back to the step s110 to repeat the change notification process from the beginning.

When a decision is made in the step s210 that the variable "Count_A" has reached the threshold Ka of the accumulated idle feed number (s210: YES), a determination is made as to whether a variable n is a lower limit "0" or not (s250). The variable n expresses a value corresponding to the protrusion amount of the protrusion portion 22 in the protrusion member 20. In an initial state (at the time of shipping from a factory), "0" is set in the variable n. In the first embodiment, the variable support portion 40 can be slid so that the protrusion amount of the protrusion portion 22 in the protrusion member 20 can be changed in two stages. Accordingly, "n=0" is given when the protrusion amount is small (i.e., the support protrusions 44 are in contact with the first supported surfaces 34), whereas "n=1" is given when the protrusion amount is large (i.e., the support protrusions 44 are in contact with the second supported surfaces 36).

When a decision is made in the step s250 that the variable n is not "0" (s250: NO), notification that the protrusion amount of the protrusion portion 22 in the protrusion member 20 needs to be reduced is performed (s260) and then a standby state is given (s270: NO) until an operation for reduction in the protrusion amount is performed by the operation panel 3. In the step s260, a message "Operate the operation lever to reduce the protrusion amount of the protrusion portion" indicating the necessity of reducing the protrusion amount is displayed on the display portion 4 to thereby perform notification. After this notification is performed, the user reduces the protrusion amount of the protrusion portion 22 by operating the operation lever 50 and then gives a notice of the completion of this operation from the operation panel 3.

When a notice of the completion of reduction in the protrusion amount is given from the operation panel 3 (s270: YES), the variable "Count_A" is reset (a value of the variable "Count_A" is set to "0") while "1" is subtracted from the variable n (n=n−1) (s280). Then, the current position of this routine goes back to the step s110 to repeat the change notification process from the beginning.

When a decision is made in the step s250 that the variable n is "0" (S250: YES), a notice of the necessity of repairing the sheet feeder 10 is given (s290) because the protrusion amount of the protrusion portion 22 in the protrusion member 20 cannot be reduced any more. Then, this change notification process is terminated. In the step s290, a message indicating the necessity of repairing the sheet feeder 10 is displayed on the display portion 4 to thereby perform notification. Incidentally, configuration may be made so that the notification is not performed in such a manner that a message is displayed on the display portion 4 but is performed in such a manner that a message is transmitted to a service center side host computer which is connected through a communication circuit network N so that data communication can be made.

When a decision is made in the step s170 that the sheet of recording paper has been conveyed (s170: YES), a timer is started to count the elapsed time after the conveyance of the sheet of recording paper (s300).

Next, formation of an image on the sheet of recording paper conveyed to the printer portion 124 is executed by the printer portion 124 (s310). In this step, formation of an image on the conveyed sheet of recording paper is performed by the printer portion 124 and the sheet of recording paper is further conveyed to the recording paper ejection tray 6.

Then, a determination is made as to whether the time "Time" when the sheet of recording paper is continuously detected by the paper feed detection sensor after the start of the timer in the step s300 is not longer than the longest time T continuously detected when a sheet of recording paper is conveyed normally (Time≦T) (s320). When a decision is made in the step s320 that the time "Time" is longer than the longest time T, there is shown a situation where a sheet of recording paper is not conveyed normally but sheets of recording paper overlapping with each other are conveyed while shifted in the direction of conveyance (i.e., multi feed occurs).

When a decision is made in the step s320 that the time "Time" is longer than the longest time T (s320: NO), a variable "Count_B" is incremented by 1 (Count_B=Count_B+1) (s330). The variable "Count_B" is a variable stored in the EEPROM 118 as an integrated variable expressing the number of times in occurrence of multi feed. In initial setting (at the time of shipping from a factory), "0" is set in the variable "Count_B".

Next, a determination is made as to whether the variable "Count_B" has reached a "threshold of the accumulated multi feed number Kb (100 in this embodiment) (Count_B=Kb) or not (s340)

When a decision is made in the step s340 that the variable "Count_B" has not reached the threshold Kb of the accumulated multi feed number (s340: NO), the current position of this routine goes back to the step s110 to repeat the change notification process from the beginning. In this manner, in this embodiment, even if multi feed occurred, the change notification process can be resumed because accidental occurrence of multi feed is estimated as long as the accumulated number (variable "Ccount_B") is small (i.e., the variable "Count_B" has not reached the threshold Kb).

On the other hand, when a decision is made in the step s340 that the variable "Count_B" has reached the threshold Kb of the accumulated multi feed number (s340: YES), a determination is made as to whether the variable n is an upper limit ("1" in this embodiment) or not (s350).

When a decision is made in the step s350 that the variable n is not the upper limit (s350: NO), notice of the necessity of increasing the protrusion amount of the protrusion portion 22 in the protrusion member 20 is given (s360) and then the notice is continued until an operation indicating the increase in the protrusion amount is input from the operation panel 3 (s370: NO) In the step s360, a message "Operate the operation lever to increase the protrusion amount of the protrusion portion" indicating the necessity of increasing the protrusion amount is displayed on the display portion 4 to thereby perform notification. The user recognizing this notification increases the protrusion amount of the protrusion portion 22 by operating the operation lever 50 and then inputs an operation indicating the completion of this operation by using the operation panel 3.

When the operation indicating the increase in the protrusion amount is input from the operation panel 3 (s370: YES), the variable "Count_B" is reset (a value of the variable "Count_B" is set to "0") while "1" is added to the variable n (n=n+1) (s380). Then, the current position of this routine goes back to the step s110 to repeat the change notification process from the beginning.

When a decision is made in the step s350 that the variable n is the upper limit (s350: YES), the change notification process is terminated after notice of the necessity of repairing the sheet feeder 10 is given (s390) because the protrusion amount of the protrusion portion 22 in the protrusion member 20 cannot be increased any more. In the step s390, a message indicating the necessity of repairing the sheet feeder 10 is displayed on the display portion 4 to thereby perform notification. Incidentally, the notification may be performed in such a manner that a message is transmitted to a service center side host computer in the same manner as in the step s290.

If a decision is made that an image needs to be formed as a next page (s400: YES) when a decision is made in the step s320 that the time "Time" is not longer than the longest time T (s320: YES), the current position of this routine goes back to the step s110 to execute the change notification process for the page.

If a decision is made in the step S400 that no image needs to be formed as a next page (s400: NO), a determination is made as to whether the variable "Total" is a predetermined threshold J (100,000 in this embodiment) or more (Total≧J) (s410).

When a decision is made in the step s410 that the variable "Total" is the predetermined threshold J or more (s410: YES), notice of the necessity of maintenance of the sheet feeder 10 is given (s420), the operation of the sheet feeder 10 is stopped (s430) and then the change notification process is terminated. In the step s420, a message indicating the necessity of maintenance of the sheet feeder 10 (e.g., exchanging the protrusion member 20 for a new one) is displayed on the display portion 4 to thereby perform notification. Incidentally, this notification may be performed in such a manner that a message is transmitted to a service center side host computer in the same manner as in the step s290 or s390.

Advantages of the First Embodiment

According to the sheet feeder 10 of the multi-function device 1 configured as described above, even when the protrusion amount of the protrusion portion 22 in the protrusion member 20 is inadequate, the operation lever 50 can be operated to change the protrusion amount and recover a state of adequate contact between the protrusion portion 22 and each sheet of recording paper at the time of feeding paper. Accordingly, the paper feeding function of the sheet feeder 10 can be recovered easily. For example, if the protrusion portion 22 is worn out by friction between the protrusion portion 22 and each sheet of recording paper at the time of feeding paper, the protrusion amount of the protrusion portion 22 can be increased to recover a state of adequate contact between the protrusion portion 22 and each sheet of recording paper at the time of feeding paper. When the protrusion portion 22 is protruded more than required, the protrusion amount of the protrusion potion 22 can be reduced to recover a state of adequate contact between the protrusion portion 22 and each sheet of recording paper likewise.

When the protrusion amount of the protrusion portion 22 in the protrusion member 20 is in a changeable range, the protrusion amount of the protrusion portion 22 can be changed to recover the paper feeding function. Accordingly, it is not necessary to ask an expert repairperson etc. to repair the protrusion member 20 or exchange the protrusion member 20 for a new one.

In the retaining unit 14, the variable pressing portion 30 can be displaced along the supported surfaces so that the supported surfaces of the variable pressing portion 30 being in contact with the support protrusions 44 of the variable support portion 40 can be changed to supported surfaces different in distance from each presser end portion 32 of the variable pressing portion 30. When the supported surfaces being in contact with the support protrusions 44 are changed in this manner, the amount of pressing (i.e., the distance of pressing) of the variable pressing portion 30 pressing the protrusion member 20 can be changed, so that the protrusion amount of the protrusion portion 22 from the upper surface 14*a* of the retaining unit 14 can be changed.

Moreover, the operation lever 50 extending from the variable pressing portion 30 to the rear of the sheet feeder 10 is attached to the retaining unit 14. Accordingly, when the operation lever 50 is slid to a direction crossing the casing surface of the sheet feeder 10, the variable pressing portion 30 can be displaced easily. Moreover, the protrusion amount of the protrusion portion 22 can be changed easily in accordance with the operation of the operation lever 50. On this occasion, because uniform pressure can be applied to the variable pressing portion 30 by a simple method in which the operation lever 50 is slid straightly to a direction crossing the casing surface, the positional relation between the variable pressing portion 30 and the variable support portion 40 can be hardly put out of order when the protrusion amount of the protrusion portion 22 is changed.

Figure 6:
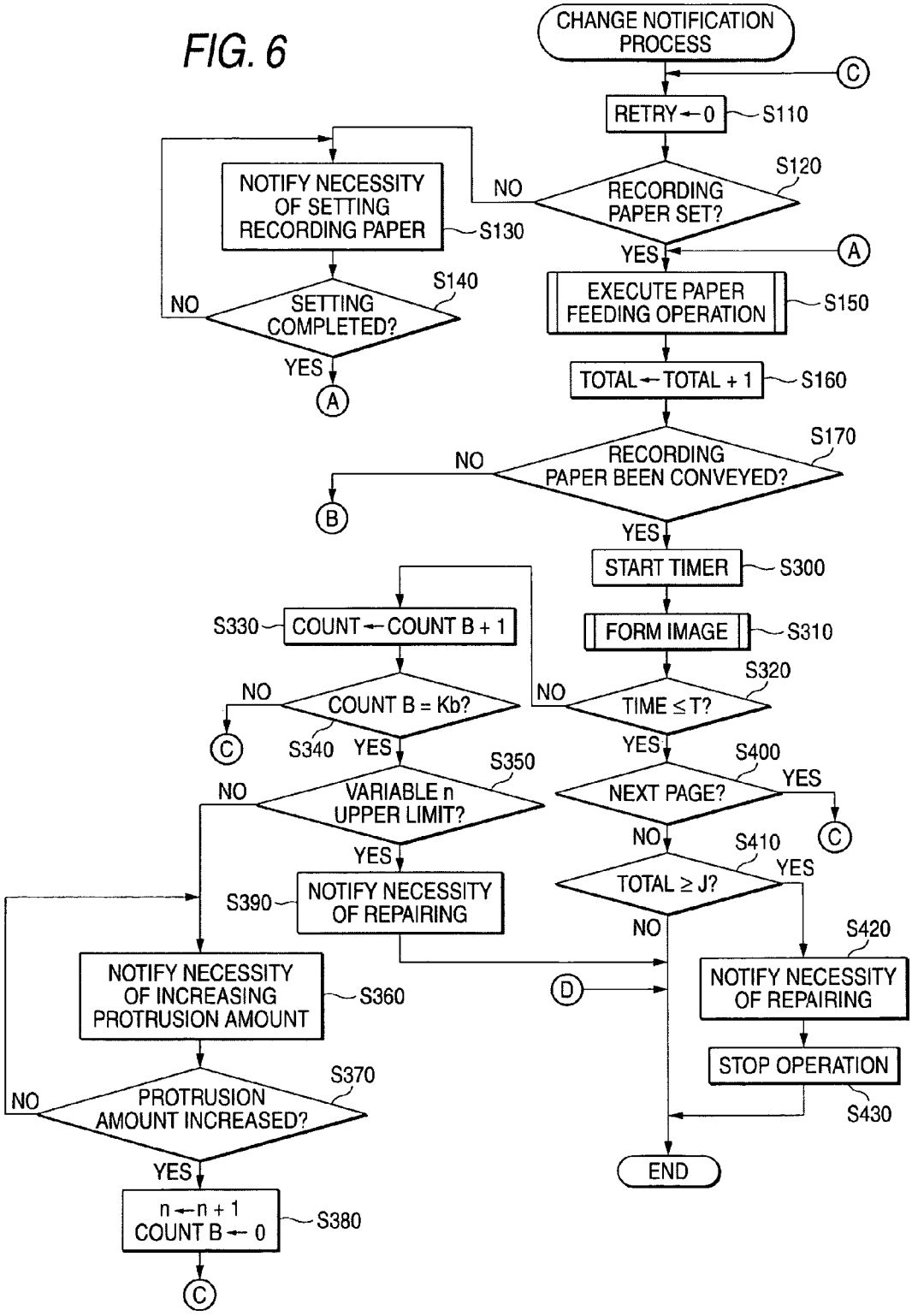
FIG. 6 is a flow chart (1/2) showing a procedure for a change notification process in a first embodiment.
Figure 7:
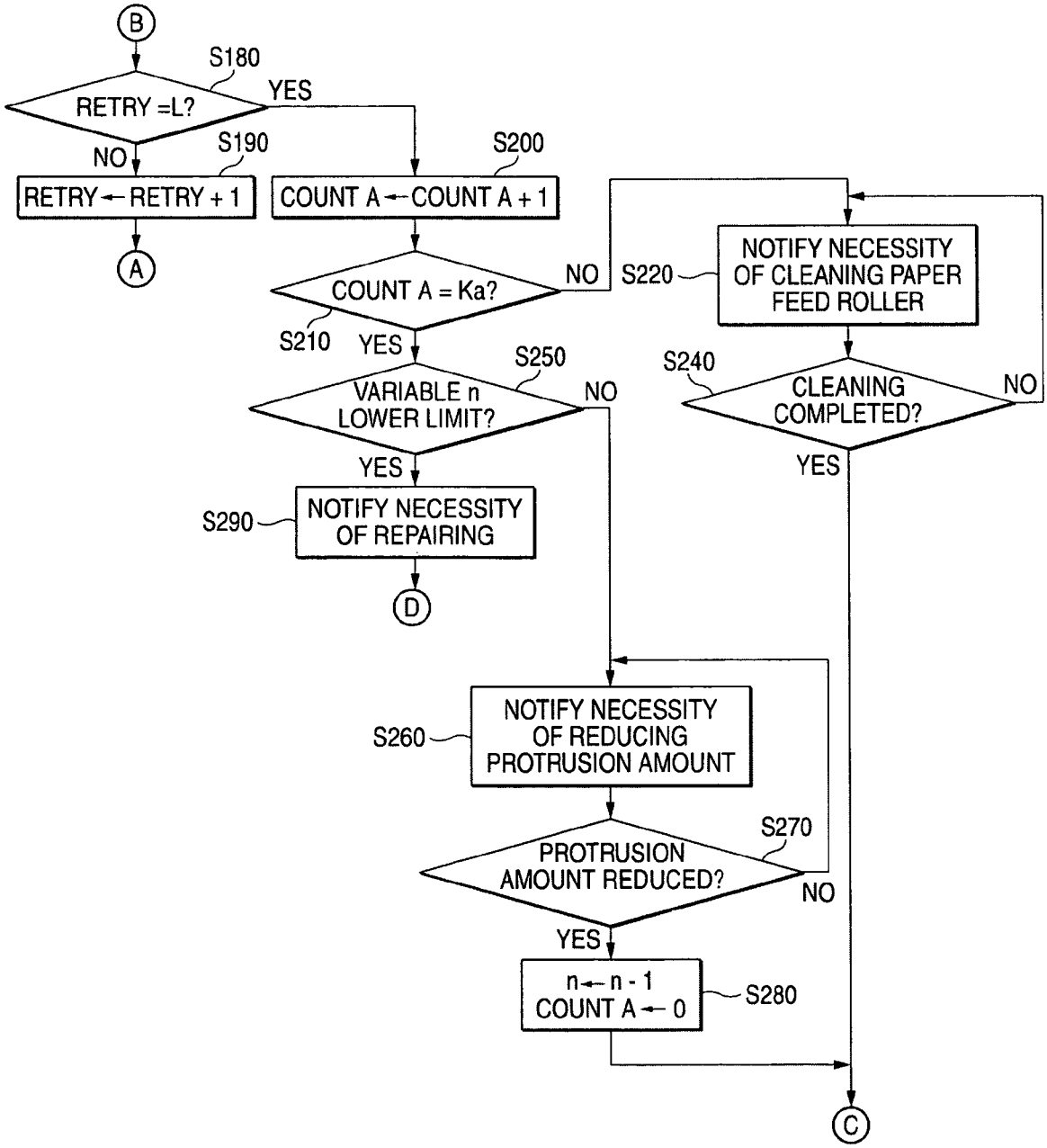
FIG. 7 is a flow chart (2/2) showing the procedure for the change notification process in the first embodiment.

In this configuration, the fact that the number of times in continuous occurrence of idle feed (variable "Retry") has reached the maximum retry number L in the condition that the accumulated number of times (variable "Count_A") in occurrence of idle feed is large (the variable "Count_A" has reached the threshold Ka) can be notified while regarded as a state in which the protrusion amount of the protrusion portion 22 in the protrusion member 20 needs to be reduced (step s260 in FIG. 7). Similarly, the fact that the accumulated multi feed number (variable "Count_B") is large (i.e., the variable "Count_B" has reached the threshold Kb) because sheets of recording paper were fed simultaneously in the sheet feeder 10 can be notified while regarded as a state in which the protrusion amount of the protrusion portion 22 in the protrusion member 20 needs to be increased (step s360 in FIG. 6).

According to the configuration in which such notification is performed by display on the display portion 4, the state in which the protrusion amount of the protrusion portion 22 has to be changed can be confirmed by the user, so that the user can recover the paper feeding function by performing an operation of changing the protrusion amount actually. When the protrusion portion 22 of the protrusion member 20 is worn out, it is possible to recover the paper feeding function by changing the protrusion amount but it is actually difficult for the user to grasp whether the protrusion portion 22 is worn out or not. Therefore, the aforementioned configuration in which the user can be notified of the necessity of changing the protrusion amount is suitable for recovering the paper feeding function at adequate timing.

In the steps s380 and s280 in FIGS. 6 and 7, variables "Count_A" and "Count_B" are reset (to zero) after the necessity of changing the protrusion amount is notified. For this reason, counting the number of times at the time of abnormal paper feeding can be restarted whenever the user receiving the notification performs an operation of changing the protrusion amount of the protrusion portion 22.

When a state in which the protrusion amount of the protrusion portion 22 needs to be reduced or increased is provided after the protrusion amount has reached the lower or upper limit, the necessity of repairing can be notified by the steps s290 and s390 in FIGS. 6 and 7. For example, in the configuration in which notification is performed by display of a message on the display portion 4, the user can recover the paper feeding function through asking a repairperson or the like a repair service because the user can confirm the necessity of repairing from the message. In the configuration in which notification is performed by transmission of a message to a service center side through the communication circuit network N, the paper feeding function can be recovered through an adequate treatment such as repairing the sheet feeder 10 because occurrence of trouble in the multi-function device 1 (sheet feeder 10) can be confirmed on the service center side receiving the message.

Second Embodiment

The multi-function device 1 according to the second embodiment is different from that according to the first embodiment in part of the retaining unit 14 of the sheet feeder 10 and the change notification process. Accordingly, only the configurations that differ from the first embodiment will be described hereinbelow.

Figure 9:
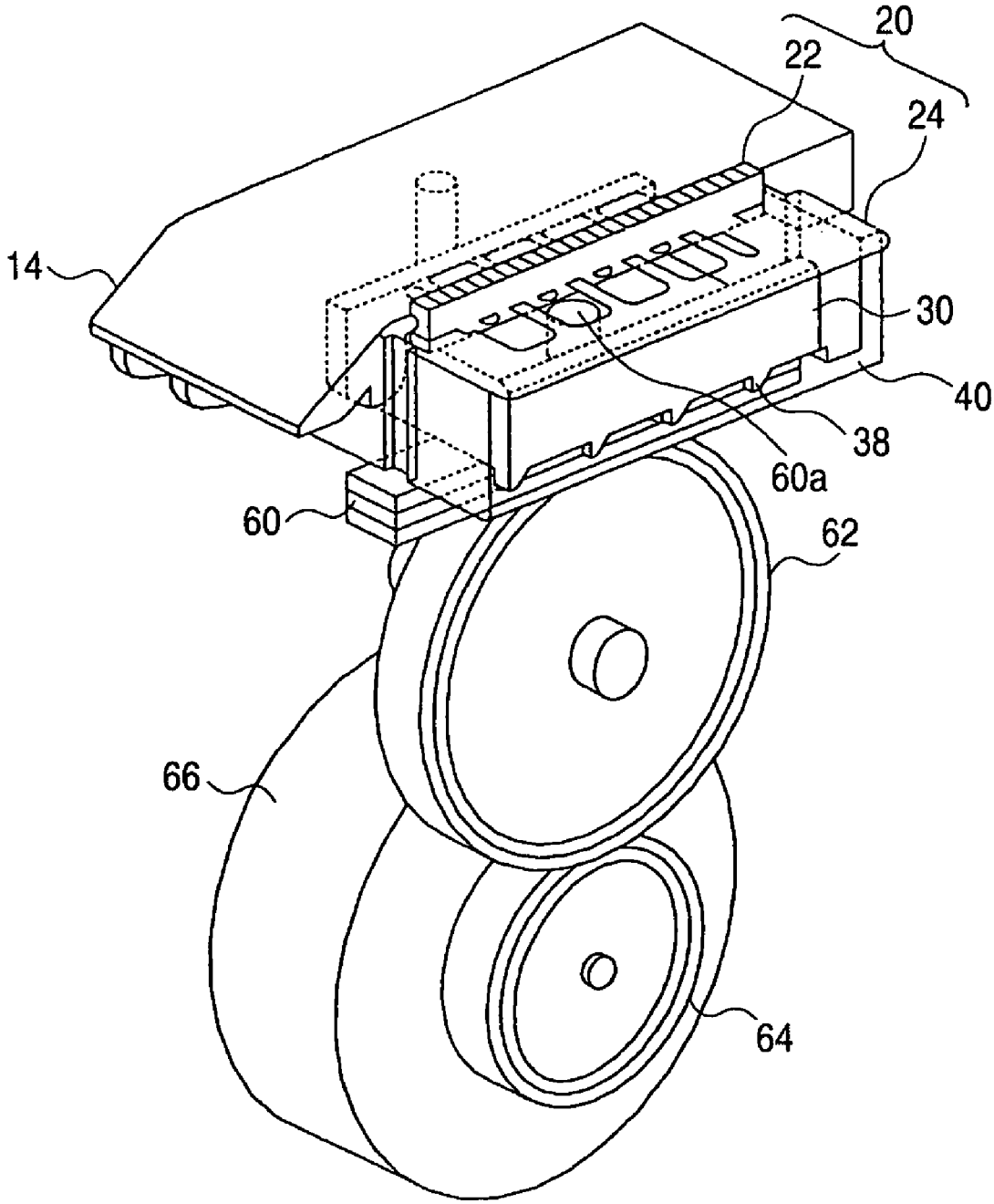
FIG. 9 is a perspective view showing the retaining unit and a change mechanism.
Figure 10A:
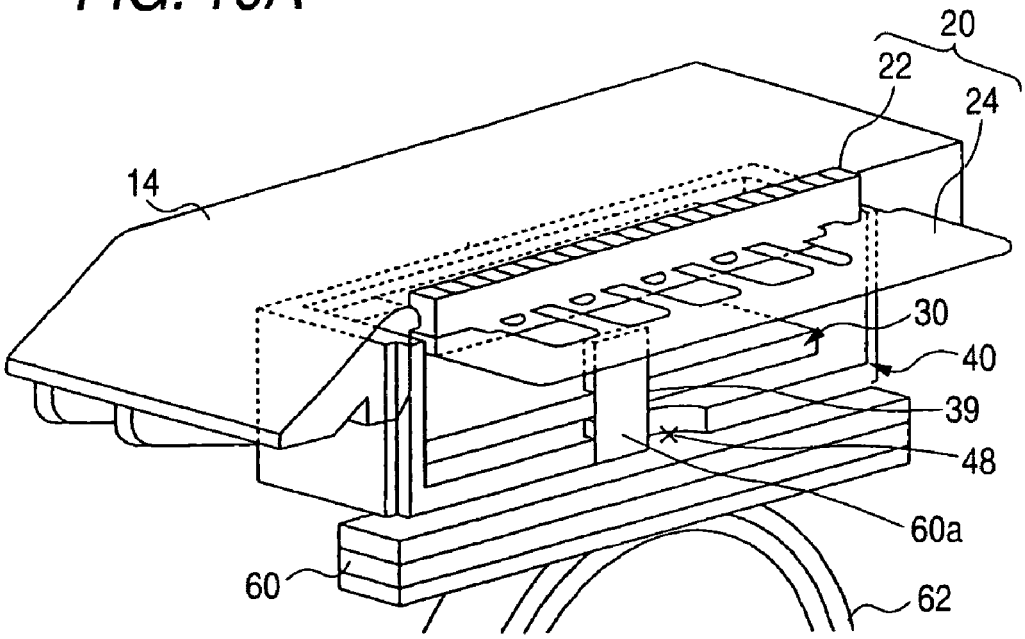
FIGS. 10A and 10B are a perspective view and a sectional view showing the retaining unit and the change mechanism.
Figure 10B:
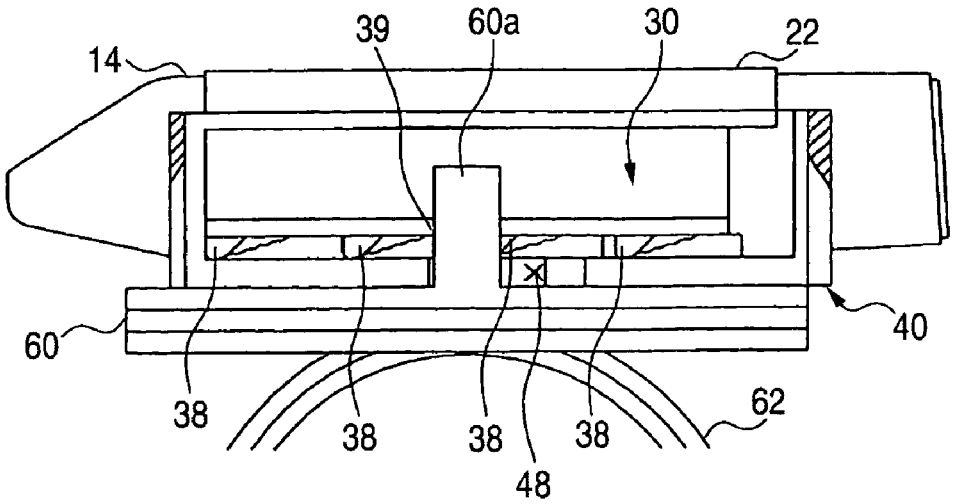
Figure 11:
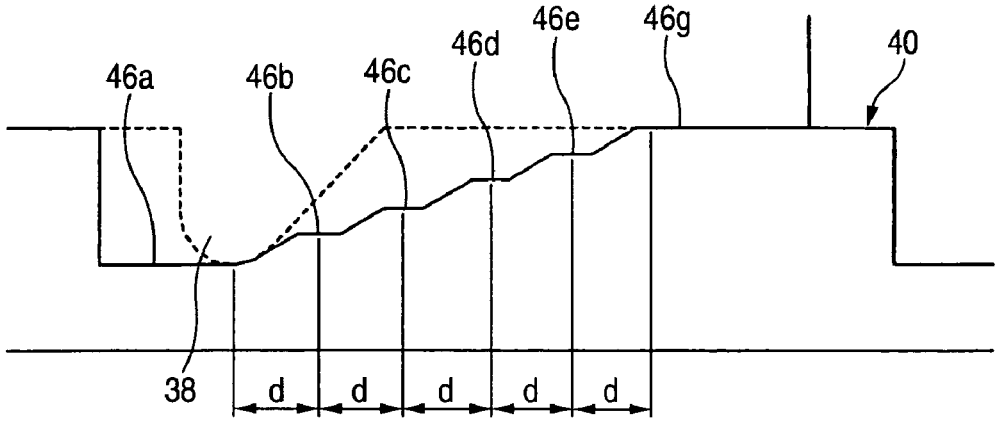
FIG. 11 is a view showing support surfaces of a variable support portion.

In the second embodiment, as shown in FIGS. 9, 10A, 10B and 11, the variable pressing portion 30 in the retaining unit 14 has contact protrusions 38 which come into contact with the variable support portion 40 and which are formed at an end portion opposite to the presser end portion 32 (i.e., on a side opposite to the presser end portion in a direction where the presser end portion 32 presses the protrusion member 20: in a lower end portion in FIG. 10B). Incidentally, FIG. 9 is a partly cutaway perspective view of the retaining unit 14, FIGS. 10A and 10B are partly cutaway perspective views of the retaining unit 14, the variable pressing portion 30 and the variable support portion 40, and FIG. 11 is a side view showing a section of the retaining unit 14, the variable pressing portion 30 and the variable support portion 40.

The variable support portion 40 has six kinds of support surfaces 46*a* to 46*g* which are different in distance from the presser end portion 32 of the variable pressing portion 30 and which are formed in positions facing the contact protrusions 38 of the variable pressing portion 30 so as to be arranged at regular intervals d in the direction of conveyance (see FIG. 11). Any one of the support surfaces 46*a* to 46*g* supports the variable pressing portion 30 while being in contact with one of the contact protrusions 38 of the variable pressing portion 30. Incidentally, this embodiment is configured so that the first, second, . . . , and sixth support surfaces 46*a* to 46*g* are arranged in order of distance to the presser end portion 32. Incidentally, in an initial state (at the time of shipping from a factory), the contact protrusions 38 of the variable pressing portion 30 are in contact with the first support surfaces 46*a* farthest from the presser end portion 32.

In the second embodiment, there is further provided a change mechanism which has: a rack 60 provided as a plate-like member disposed under the variable support portion 40; an idle gear 62 linked to the rack 60 so as to rotate along the lengthwise direction of the rack 60; a motor gear 64 for rotating the idle gear 62; and a pulse motor 66 for transmitting motive power to the motor gear 64.

The rack 60 is a plate-like member extending in the paper feeding direction (left-right direction in FIG. 10B). A protrusion portion 60*a* extending upward through a through-hole 48 formed in the variable support portion 40 and a through-hole 39 formed in the variable pressing portion 30 is formed in the central position along the lengthwise direction of the rack 60. In this embodiment, the width (length in the left-right direction in FIG. 10B) of the through-hole 48 of the variable support portion 40 is larger than that of the protrusion portion 60*a* but the width of the through-hole 39 of the variable pressing portion 30 is equal to that of the protrusion portion 60*a*, so that the protrusion portion 60*a* is fitted into the through-hole 39. For this reason, when the rack 60 is displaced along the paper feeding direction, only the variable pressing portion 30 is displaced together with the rack 60.

Moreover, the rack 60 is linked to the idle gear 62. Accordingly, when the idle gear 62 rotates forward (clockwise in FIG. 9), the rack 60 is displaced toward a direction opposite to the direction of conveyance. On this occasion, the variable pressing portion 30 is displaced with the displacement of the rack 60, so that the support surfaces of the variable support portion 40 being in contact with the contact protrusions 38 of the variable pressing portion 30 are changed in order of the first to the sixth support surfaces 46*a* to 46*g*. When the support surfaces 46 being in contact with the contact protrusions 38 are changed in this manner, the protrusion amount of the protrusion portion 22 from the upper surface 14*a* of the retaining unit 14 can be increased in the same manner as in the first embodiment.

On the other hand, when the idle gear 62 rotates backward (counterclockwise in FIG. 9), the rack 60 is displaced toward the direction of conveyance. The variable pressing portion 30 is displaced with the displacement of the rack 60, so that the support surfaces of the variable support portion 40 being in contact with the contact protrusions 38 of the variable pressing portion 30 are changed in order of the sixth to the first support surfaces 46*g* to 46*a*. When the support surfaces 46 being in contact with the contact protrusions 38 are changed in this manner, the protrusion amount of the protrusion portion 22 from the upper surface 14*a* of the retaining unit 14 can be reduced in the same manner as in the first embodiment.

As described above, in the second embodiment, because the protrusion amount of the protrusion portion 22 in the protrusion member 20 can be changed in accordance with the rotation of the idle gear 62, the protrusion amount of the protrusion portion 22 can be changed in six stages whenever a control command for controlling the amount of rotation of the idle gear 62, that is, for controlling the idle gear 62 to rotate by a predetermined rotation angle is given to the pulse motor 66.

Change Notification Process in the Second Embodiment

The change notification process in the second embodiment is formed so that steps s500 to s510 which will be described later are performed instead of the steps s260, s270, s360 and s370 in FIGS. 6 and 7.

Figure 12:
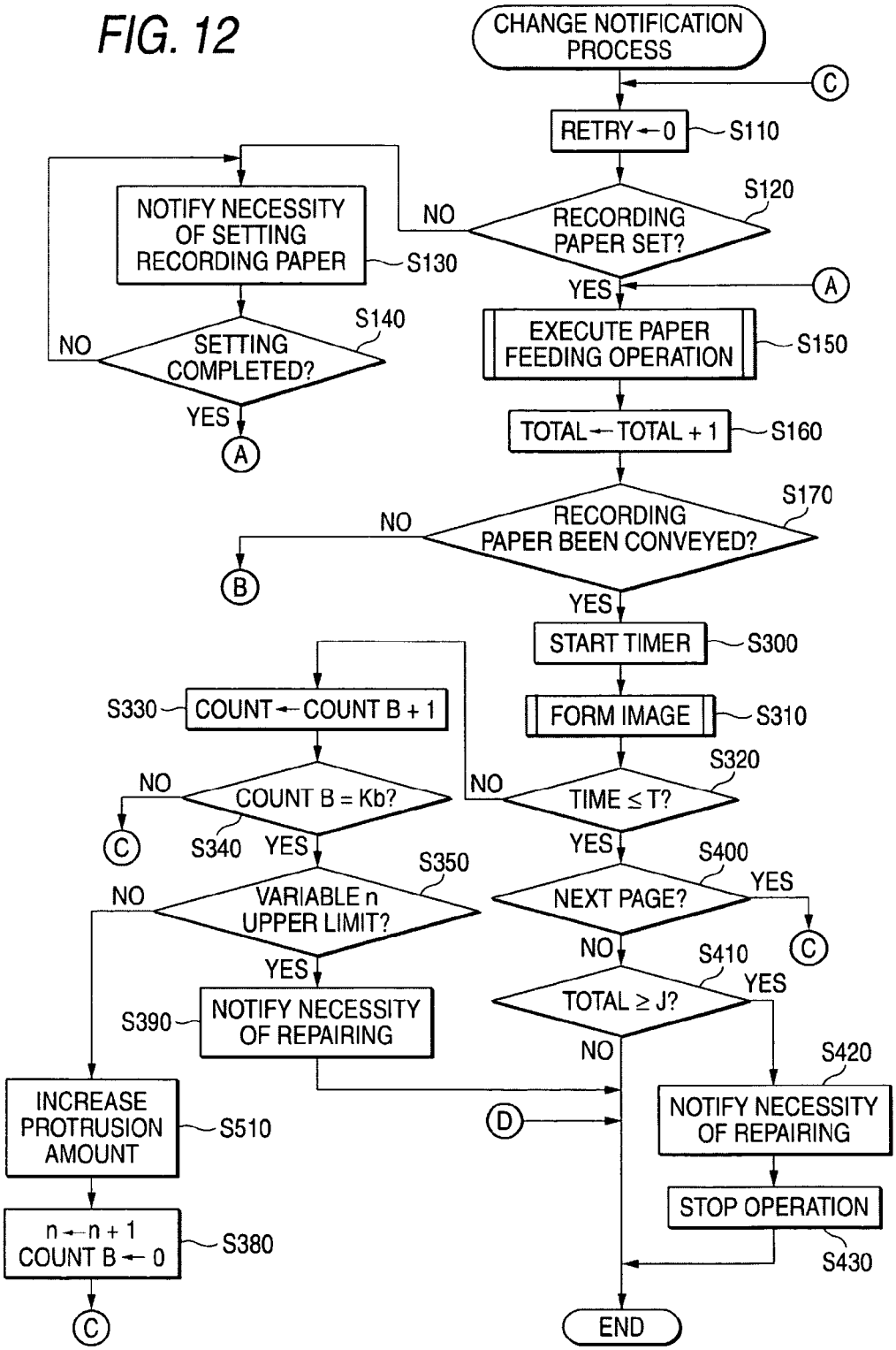
FIG. 12 is a flow chart (1/2) showing a procedure for a change notification process in a second embodiment.
Figure 13:
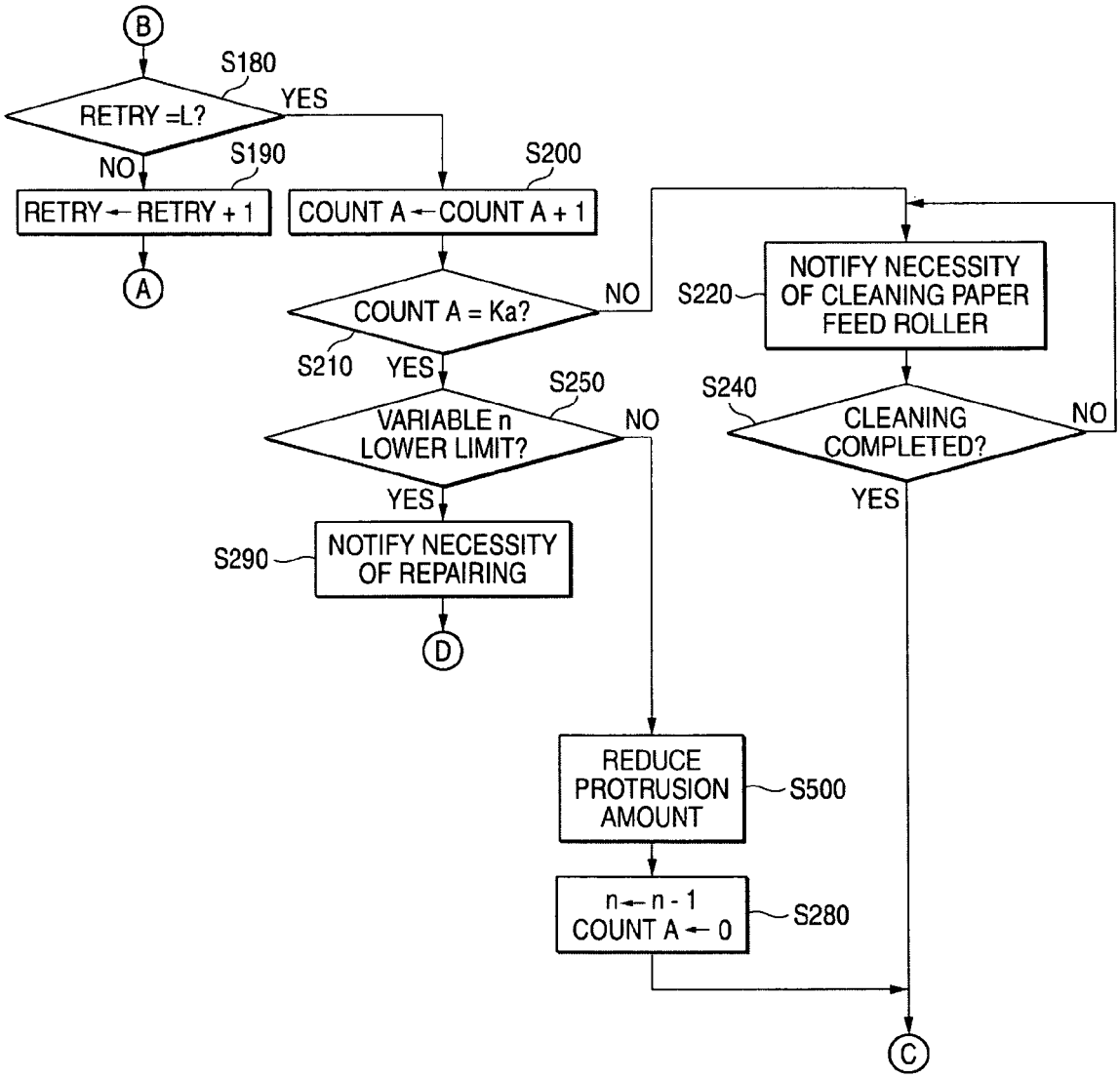
FIG. 13 is a flow chart (2/2) showing the procedure for the change notification process in the second embodiment.

Specifically, as shown in FIGS. 12 and 13, when the variable n in the step s250 is not the lower limit (s250: NO), the protrusion amount of the protrusion portion 22 in the protrusion member 20 is reduced by one stage (s500) and then the current position of this routine goes to the step s280. In the step s500, a control command is given to the pulse motor 66 in the form of a control amount so that the rack 60 can be moved in the direction of conveyance by a distance equivalent to the interval d between adjacent support surfaces of the variable pressing portion 30 in the direction of conveyance. As a result, the support surfaces of the variable support portion 40 being in contact with the contact protrusions 38 of the variable pressing portion 30 are changed from the n-th support surfaces 46 to the (n−1)th support surfaces 46, so that the protrusion amount of the protrusion portion 22 can be reduced by one stage.

When the variable n in the step s350 is not the upper limit (s350: NO), the protrusion amount of the protrusion portion 22 in the protrusion member 20 is increased by one stage (s510) and then the current position of this routine goes to the step s380. In the step s510, a control command is given to the pulse motor 66 in the form of a control amount so that the rack 60 can be moved in a direction opposite to the direction of conveyance by a distance equivalent to the interval d between adjacent support surfaces of the variable pressing portion 30 in the direction of conveyance. As a result, the support surfaces of the variable support portion 40 being in contact with the contact protrusions 38 of the variable pressing portion 30 are changed from the n-th support surfaces 46 to the (n+1)th support surfaces 46, so that the protrusion amount of the protrusion portion 22 can be increased by one stage.

In the step s350 in FIG. 12, the upper limit of the variable n is set at "6" and a determination is made as to whether the variable n is the upper limit or not, because the protrusion amount of the protrusion portion 22 in this embodiment can be changed in six stages.

Advantages of Second Embodiment

According to the sheet feeder 10 of the multi-function device 1 configured as described above, the following actions and advantages can be obtained in addition to the actions and advantages obtained from the configuration the same as that of the first embodiment.

According to the sheet feeder 10 of the second embodiment, the protrusion amount of the protrusion portion 22 in the protrusion member 20 is reduced while the fact that the number of times in continuous occurrence of idle feed (variable "Retry") has reached the maximum retry number L in the condition that the accumulated number of times in occurrence of idle feed (variable "Count_A") is large (i.e., the variable "Count_A" has reached the threshold Ka) is regarded as a state in which the protrusion amount of the protrusion portion 22 in the protrusion member 20 has to be reduced (step s500 in FIG. 13). Similarly, the protrusion amount of the protrusion portion 22 in the protrusion member 20 is increased while the fact that the accumulated number of times in occurrence of multi feed (variable "Count_B") in which sheets of recording paper are fed simultaneously in the sheet feeder 10 is large (i.e., the Count_B" has reached the threshold Kb) is regarded as a state in which the protrusion amount of the protrusion portion 22 in the protrusion member 20 has to be increased (step s510 in FIG. 13). When the protrusion amount of the protrusion portion 22 in the protrusion member 20 is changed in this manner, the paper feeding function can be recovered automatically.

In the steps s380 and s280 in FIGS. 12 and 13, the variables "Count_A" and "Count_B" are reset (to zero) after the protrusion amount is changed. For this reason, counting the number of times in abnormal paper feeding can be restarted whenever the protrusion amount is changed.

Modifications

Although embodiments of the invention have been described above, it is a matter of course that the invention is not limited to the embodiments at all and that various forms may be taken without departing from the technical scope of the invention.

Although the aforementioned embodiments have been described on the case where the configuration in which the sheet feeder according to the invention is applied to a multi-function device is taken as an example, the sheet feeder according to the invention may be applied to any other apparatus than the multi-function device as long as the apparatus needs paper feeding.

In the aforementioned embodiments, the configuration in which the retaining unit 14 has a variable pressing portion 30 for pressing the protrusion member 20 from the lower side, and a variable support portion 40 for supporting the variable pressing portion 30 and in which the variable pressing portion 30 can be slid to change the protrusion amount of the protrusion portion 22 in the protrusion member 20. However, besides this configuration, any other configuration may be used as the configuration for changing the protrusion amount of the protrusion portion 22 in the protrusion member 20. For example, not the variable pressing portion 30 but the variable support portion 40 may be slid to press up the variable pressing portion 30 to thereby change the protrusion amount of the protrusion portion 22. The invention may be achieved by any other configuration than the configuration having the variable pressing portion 30 and the variable support portion 40.

Figure 14A:
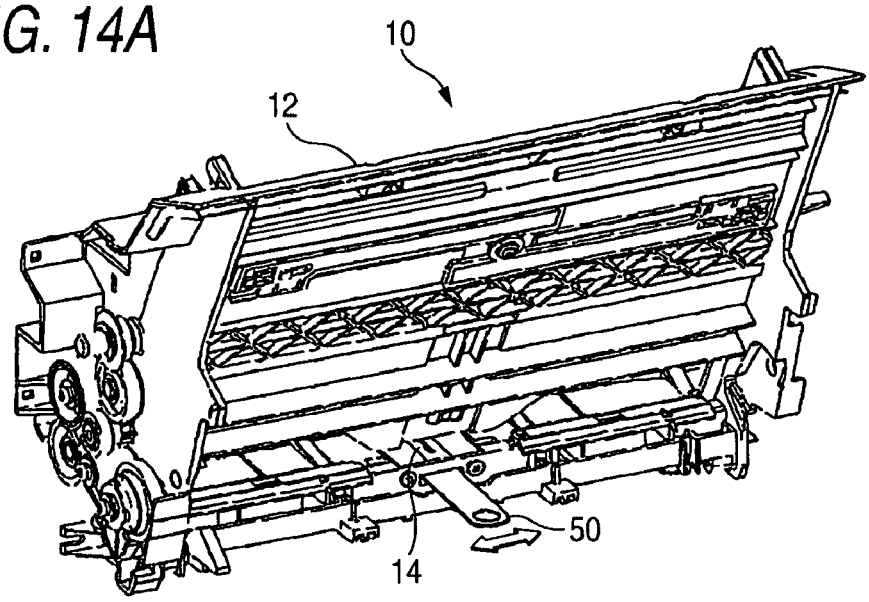
FIG. 14A is a perspective view showing a state in which the operation lever in the sheet feeder in another embodiment is operated.
Figure 14B:
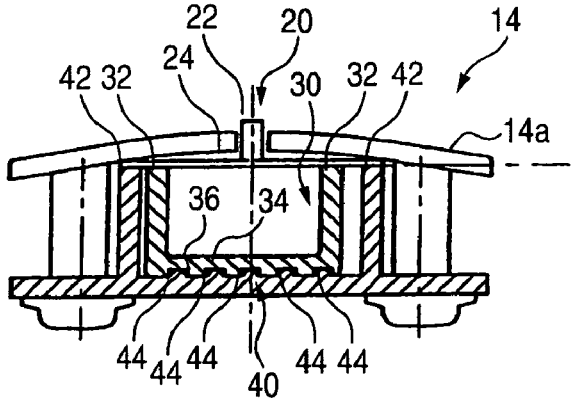
FIGS. 14B and 14C are sectional views taken along a plane perpendicular to the paper feeding direction in the retaining unit.
Figure 14C:
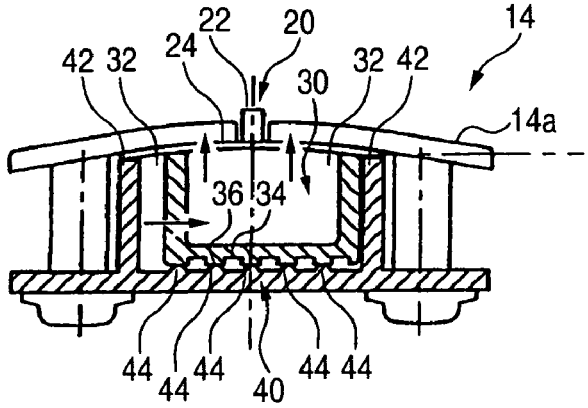

In the first embodiment, the configuration in which the operation lever 50 is configured to be slidable in a direction crossing the casing surface to displace the variable pressing portion 30 is taken as an example. However, for example, the operation lever 50 may be formed so that the operation lever 50 can be slid in a direction parallel to the casing surface to thereby displace the variable pressing portion 30 along the supported surfaces. In this case, configuration may be made so that the supported surfaces 34 and 36 in the variable pressing portion 30 are formed along the paper feeding direction while the support protrusions 44 in the variable support portion 40 are formed along the paper feeding direction as shown in FIGS. 14B and 14C, and that the operation lever 50 can be displaced along the casing surface (i.e. stacking portion 12) as shown in FIG. 14A. In this case, because the length of the operation lever 50 exposed from the casing is unchanged in accordance with the operation of the operation lever 50, change in the exposed portion of the operation lever 50 need not be considered when the multi-function device 1 is set up.

The thresholds (L, T, Ka, Kb and J) used in the change notification process in the aforementioned embodiments may be configured so that the thresholds are stored in the EEPROM 118 and changed to arbitrary values when an operation according to a predetermined procedure is made by the operation panel 3. The thresholds may be configured so that the thresholds are changed to arbitrary values on the basis of an instruction given from the communication circuit network N side (e.g., a service center) According to this configuration, the "thresholds" used in the change notification process can be changed arbitrarily on the user side or on the service center side.

In the aforementioned embodiments, CPU 112, ROM 114, RAM 116, and EEPROM 118, which serve as a controller, are implemented as a programmed general purpose computer. It will be appreciated by those skilled in the art that the controller can be implemented using a single special purpose integrated circuit (e.g., ASIC: Application Specific Integrated Circuit) having a main or central processor section for overall, system-level control, and separate sections dedicated to performing various different specific computations, functions and other processes under control of the central processor section, or a plurality of separate dedicated or programmable integrated or other electronic circuits or devices (e.g., hardwired electronic or logic circuits such as discrete element circuits, or programmable logic devices such as PLDs (PLD: Programmable Logic Device), PLAs (PLA: Programmable Logic Array), PALs (PAL: Programmable Array Logic) or the like). The controller can be implemented using a suitably programmed general purpose computer, such as a microprocessor, microcontroller or other processor device (CPU, MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

As described above in detail, according to the embodiment, even if the protrusion amount (amount of protrusion) of the protrusion member is inadequate, the protrusion amount of the protrusion member can be changed by the protrusion amount adjusting mechanism to recover a state in which the protrusion member is in adequate contact with each sheet of recording paper at the time of paper feeding. Accordingly, the paper feeding function of the sheet feeder can be recovered easily.

For example, when the protrusion member is worn out by friction between the protrusion member and each sheet of recording paper at the time of paper feeding, the protrusion amount of the protrusion member can be increased to recover a state in which the protrusion member is in adequate contact with each sheet of recording paper at the time of paper feeding. When the protrusion member is protruded more than required, the protrusion amount of the protrusion member can be reduced to recover a state in which the protrusion member is in adequate contact with each sheet of recording paper likewise.

When the protrusion amount of the protrusion member is in a changeable range, the paper feeding function can be recovered by a simple operation of changing the protrusion amount of the protrusion member. Accordingly, it is unnecessary for the user to ask an expert repairperson or the like to repair the protrusion member or exchange the protrusion member for a new one.

Although any configuration can be used for the protrusion amount adjusting mechanism as long as the protrusion amount of the protrusion member from the inclined surface can be changed.

According to one configuration described above with reference to the embodiments, when the variable support portion is displaced along the supported surfaces (relative to the variable pressing portion), the supported surfaces of the variable pressing portion being in contact with the support protrusions of the variable support portion can be changed to other supported surfaces. When the supported surfaces being in contact with the support protrusions are changed in this manner, the amount of pressing (distance of pressing) of the variable pressing portion pressing the protrusion member can be also changed to thereby change the protrusion amount of the protrusion member from the inclined surface of the variable pressing portion.

According to another configuration described above with reference to the embodiments, when the variable support portion is displaced along the supported surfaces (relative to the variable pressing portion), the support surfaces of the variable support portion being in contact with an end portion opposite to the presser end portion of the variable pressing portion can be changed to other supported surfaces. When the support surfaces being in contact with an end portion opposite to the presser end portion are changed in this manner, the amount of pressing (distance of pressing) of the variable pressing portion pressing the protrusion member can be also changed to thereby change the protrusion amount of the protrusion member from the inclined surface of the variable pressing portion.

The sheet feeder may be configured to have the operation member extending from the protrusion amount adjusting mechanism to the outside of the sheet feeder, the operation member being provided to be displaced to thereby displace the variable support portion along the supported surfaces.

According to this configuration, when the operation member is operated, the protrusion amount of the protrusion member can be changed easily.

For example, when the operation member is formed so that the variable support portion can be displaced (relatively) along the supported surfaces when the operation member is slid in a direction along the casing surface of the sheet feeder, change of the exposed portion of the operation member need not be considered when the sheet feeder is set up because the length of the operation member exposed from the casing is unchanged in accordance with the operation of the operation member. For example, when the operation member is formed so that the variable support portion can be displaced (relatively) along the supported surfaces when the operation member is slid in a direction crossing the casing surface of the sheet feeder, the positional relation between the variable pressing portion and the variable support portion is hardly shifted when the protrusion amount of the protrusion member is changed because the operation member can be slid straightly to apply pressure on the protrusion amount adjusting mechanism evenly.

When the protrusion member is worn out, the protrusion amount of the protrusion member may be changed to recover the paper feeding function but it is difficult for the user to grasp whether the protrusion member is actually worn out or not. It is therefore preferable that notice of the necessity of changing the protrusion amount of the protrusion member can be given to the user by some method.

For example, when the protrusion member is worn out, the protrusion member cannot come into contact with the recording medium adequately so that paper feeding is not normally performed by the sheet feeding mechanism. It may be therefore conceived that notice of the necessity of changing the protrusion amount of the protrusion member is given when such abnormal paper feeding occurs by a number of times.

Therefore, for example, the sheet feeder may be configured to have: a number counting unit for counting the number of times in which paper feeding was not normally performed by the sheet feeding mechanism; and a change notification unit for notifying the necessity of changing the protrusion amount of the protrusion member when the number of times counted by the number counting unit is not smaller than a predetermined threshold.

According to this configuration, notice of the necessity of changing the protrusion amount of the protrusion member can be confirmed to the user by the change notification unit. The user can recover the paper feeding function by actually performing an operation of changing the protrusion amount.

In this configuration, for example, the number of times of idle feed in which paper feeding was not performed though the sheet feeding mechanism was operated can be used as the "number of times in which paper feeding was not normally performed" counted by the number counting unit. Because such idle feed is caused by the fact that the protrusion member protruded more than required disturbs the conveyance of the recording medium in the paper feeding direction, occurrence of idle feed by a number of times can be notified as a state in which the protrusion amount of the protrusion member has to be reduced.

Therefore, for example, the sheet feeder may be configured so that the change notification unit notifies the necessity of reducing the protrusion amount of the protrusion member when the number of times of idle feed counted by the number counting unit is not smaller than a first predetermined threshold.

According to this configuration, the user is notified by the change notification unit so that the user can confirm that the protrusion amount of the protrusion member has to be reduced. The user can recover the paper feeding function at adequate timing by actually performing an operation of reducing the protrusion amount.

For example, the number of times of multi feed in which sheets of recording medium were fed simultaneously by the sheet feeding mechanism while shifted in the paper feeding direction may be used as the "number of times in which paper feeding was not normally performed" counted by the number counting unit. Because such multi feed is caused by the fact that the protrusion member short of the protrusion amount cannot prevent other sheets of recording medium than the sheet of recording medium to be fed originally from being conveyed in the paper feeding direction, occurrence of multi feed by a number of times can be notified as a state in which the protrusion amount of the protrusion member has to be increased.

Therefore, for example, the sheet feeder may be configured so that the change notification unit notifies the necessity of increasing the protrusion amount of the protrusion member when the number of times of multi feed counted by the number counting unit is not smaller than a second predetermined threshold.

According to this configuration, the user can be notified by the change notification unit so that the user can confirm that the protrusion amount of the protrusion member has to be increased. The user can recover the paper feeding function at adequate timing by actually performing an operation of increasing the protrusion amount.

In the configuration in which the number of times is counted by the number counting unit, the sheet feeder may be configured so that the change notification unit performs notification by sending a message indicating the necessity of changing the protrusion amount of the protrusion member to a user; and the number counting unit resets the counted number of times when receiving an operation indicating the completion of changing of the protrusion amount of the protrusion member from the user after the message is sent by the change notification unit.

According to this configuration, counting the number of times in which paper feeding was not normally performed can be restarted whenever the user receiving the message from the change notification unit performs an operation of changing the protrusion amount of the protrusion member.

Incidentally, as described above, when the protrusion member is worn out, the protrusion amount of the protrusion member may be changed to recover the paper feeding function but it is difficult for the user to grasp whether the protrusion member is actually worn out or not. It is therefore preferable that the protrusion amount of the protrusion member can be changed automatically when the protrusion amount has to be changed. For example, when the protrusion member is worn out, the protrusion member cannot come into contact with the recording medium adequately so that paper feeding cannot be normally performed by the sheet feeding mechanism. It may be therefore conceived that the protrusion amount of the protrusion member is changed automatically when abnormal paper feeding occurs by a number of times.

Therefore, for example, the sheet feeder may be configured so that the protrusion amount adjusting mechanism includes a change mechanism for changing the protrusion amount of the protrusion member in response to an instruction given from the outside; and the sheet feeder further includes: a number counting unit for counting the number of times in which paper feeding was not normally performed by the sheet feeding mechanism; and a command outputting unit that outputs a command for instructing the change mechanism of the protrusion amount adjusting mechanism to change the protrusion amount when the number of times counted by the number counting unit is not smaller than a predetermined threshold.

According to this configuration, the protrusion amount of the protrusion member can be changed by the change mechanism to recover the paper feeding function automatically when paper feeding is not normally performed by a number of times not smaller than the threshold.

In this configuration, for example, the number of times of idle feed in which paper feeding was not performed though the sheet feeding mechanism was operated can be used as the "number of times in which paper feeding was not normally performed" counted by the number counting unit. Because such idle feed is caused by the fact that the protrusion member protruded more than required disturbs the conveyance of the recording medium in the paper feeding direction, the protrusion amount may be reduced while occurrence of idle feed by a number of times is regarded as a state in which the protrusion amount of the protrusion member has to be reduced.

Therefore, for example, the sheet feeder may be configured so that the command outputting unit instructs the change mechanism of the protrusion amount adjusting mechanism to reduce the protrusion amount of the protrusion member when the number of times of idle feed counted by the number counting unit is not smaller than the threshold.

According to this configuration, the protrusion amount of the protrusion member can be reduced by the change mechanism to recover the paper feeding function automatically when idle feed occurs by a number of times not smaller than the threshold so that the protrusion amount of the protrusion member has to be reduced.

For example, the number of times of continuous idle feed in which paper feeding was not continuously performed though the sheet feeding mechanism was operated and the accumulated number of times of idle feed in which paper feeding was not performed though the sheet feeding mechanism was operated so far can be used as the "number of times in which paper feeding was not normally performed" counted by the number counting unit.

Therefore, the sheet feeder may be configured so that the number counting unit counts the number of times of continuous idle feed in which paper feeding was not continuously performed though the sheet feeding mechanism was operated repeatedly, and counts the accumulated number of times of idle feed in which paper feeding was not performed though the sheet feeding mechanism was operated so far; and the command outputting unit instructs the change mechanism of the protrusion amount adjusting mechanism to reduce the protrusion amount of the protrusion member on the basis of the numbers of times counted by the number counting unit when the number of times of continuous idle feed is not smaller than a first predetermined threshold and the accumulated number of times of idle feed is not smaller than a second predetermined threshold.

According to this configuration, the protrusion amount of the protrusion member can be reduced by the change mechanism to recover the paper feeding function automatically when continuous idle feed occurs by a number of times not smaller than the first threshold and accumulated idle feed occurs by a number of times not smaller than the second threshold so that the protrusion amount of the protrusion member has to be reduced.

According to this configuration, a determination can be made on the basis of the continuous idle feed number and the accumulated idle feed number as to whether the protrusion amount of the protrusion member has to be reduced or not. Accordingly, when the first and second thresholds are set adequately, the paper feeding function can be recovered at more adequate timing.

As described above, in the configuration in which the protrusion amount of the protrusion member is reduced, the protrusion amount cannot be reduced out of a changeable range. In such a state that the protrusion amount has reached the lower limit, some trouble is estimated to occur in the sheet feeder. It is therefore preferable that the user can be notified of the arrival at the lower limit.

Therefore, for example, the sheet feeder may be configured so that the sheet feeder further includes: a protrusion monitoring unit for monitoring the protrusion amount of the protrusion member changed by the protrusion amount adjusting mechanism; and a lower limit notification unit for giving notice of the arrival of the protrusion amount of the protrusion member at a lower limit when the number of times of idle feed is not smaller than the threshold after the protrusion amount counted by the protrusion monitoring unit has reached the lower limit of the protrusion amount which can be changed by the protrusion amount adjusting mechanism.

According to this configuration, the user can be notified of the arrival of the protrusion amount at the lower limit when the number of times of idle feed is not smaller than the threshold after the arrival of the protrusion amount of the protrusion member at the lower limit so that the protrusion amount has to be reduced.

For example, in the configuration in which notification by the lower limit notification unit is performed in such a manner that a message is sent to a service center through a communication network, occurrence of some trouble in the sheet feeder can be confirmed on the service center side receiving this message. The paper feeding function can be recovered through an adequate treatment such as repairing of the sheet feeder. In the configuration in which notification by the lower limit notification unit is performed by display of a message etc., the user can confirm occurrence of some trouble from the message. The user can recover the paper feeding function through asking a repairperson or the like a repairing service.

The lower limit notification unit in this configuration may be configured so that notification is performed when the protrusion amount reaches the lower limit regardless of whether the number of times of idle feed is the threshold or more.

For example, the number of times of multi feed in which sheets of recording medium were fed simultaneously by the sheet feeding mechanism while shifted in the paper feeding direction can be used as the "number of times in which paper feeding was not normally performed" counted by the number counting unit. Because such multi feed is caused by the fact that the protrusion member short of the protrusion amount cannot prevent other sheets of recording medium than the sheet of recording medium to be conveyed originally from being conveyed in the paper feeding direction, the protrusion amount of the protrusion member can be increased while occurrence of multi feed by a number of tomes is regarded as a state in which the protrusion amount has to be increased.

Therefore, for example, the sheet feeder may be configured so that the number counting unit counts the number of times of multi feed in which sheets of recording medium were fed simultaneously by the sheet feeding mechanism; and the command outputting unit instructs the change mechanism of the protrusion amount adjusting mechanism to increase the protrusion amount of the protrusion member when the number of times of multi feed counted by the number counting unit is not smaller than the threshold.

According to this configuration, the protrusion amount of the protrusion member can be increased by the change mechanism to recover the paper feeding function automatically when multi feed occurs by a number of times not smaller than the threshold so that the protrusion amount of the protrusion member has to be increased.

As described above, in the configuration in which the protrusion amount of the protrusion member is increased, it is a matter of course that the protrusion amount cannot be increased out of a changeable range. In such a state that the protrusion amount reaches the upper limit, the protrusion member is estimated to be required to be exchanged for a new one. It is therefore preferable that this fact can be notified.

Therefore, for example, the sheet feeder may be configured so that the sheet feeder further includes: a protrusion monitoring unit for monitoring the protrusion amount of the protrusion member changed by the protrusion amount adjusting mechanism; and an upper limit notification unit for giving notice of the arrival of the protrusion amount of the protrusion member at an upper limit when the number of times of multi feed is not smaller than the threshold after the protrusion amount counted by the protrusion monitoring unit has reached the upper limit of the protrusion amount which can be changed by the protrusion amount adjusting mechanism.

According to this configuration, the user can be notified of the necessity of exchanging the protrusion member for a new one when the number of times of multi feed is not smaller than the threshold after the arrival of the protrusion amount of the protrusion member at the upper limit so that the protrusion amount has to be increased.

For example, in the configuration in which notification by the upper limit notification unit is performed in such a manner that a message is sent to a service center through a communication network, the necessity of exchanging the protrusion member for a new one can be confirmed on the service center side receiving this message. The paper feeding function can be recovered through an adequate treatment such as exchange of the protrusion member. In the configuration in which notification by the upper limit notification unit is performed by display of a message etc., the user can confirm the necessity of exchanging the protrusion member for a new one from the message. The user can recover the paper feeding function through asking a repairperson or the like a repairing service.

Incidentally, the upper limit notification unit in this configuration may be configured so that notification is performed when the protrusion amount reaches the upper limit regardless of whether the number of times of multi feed is the threshold or more.

In the configuration in which the number of times is counted by the number counting unit, the sheet feeder may be configured so that the number counting unit resets the counted number of times when the protrusion amount of the protrusion member is changed by the command outputting unit.

According to this configuration, counting the number of times in which paper feeding was not normally performed can be restarted whenever the protrusion amount of the protrusion member is changed.

Although the "threshold" which is the number of times counted by the number counting unit and which serves as a trigger for the operation of each means may be set as a predetermined value estimated to make continuous normal paper feeding impossible when the protrusion member is not adequately protruded, the "threshold" may be formed so that it can be changed to an arbitrary vale by the user or the like.

To achieve the latter, for example, the sheet feeder may be configured so that the sheet feeder further includes a setting changing unit by which values set as the thresholds can be changed arbitrarily in response to an instruction given from the outside of the sheet feeder.

According to this configuration, the "threshold" serving as a trigger for the operation of each units can be changed arbitrarily by the user or the like.

According to the embodiments, there is provided a program product for causing a computer system to execute procedures performed by the controller that serves as the number counting unit and the change notification unit.

The computer system controlled by this program product can form a part of the sheet feeder described above with reference to the embodiments.

The program product may be provided as a program product for causing the computer system function as the protrusion monitoring unit, the lower limit notification unit, the upper limit notification unit and the setting changing unit described above.

The program product is constituted by a sequence of instructions suitable for computer processing. For example, the program product is provided to the computer system or to the user of the computer system through a recording medium such as an FD, a CD-ROM, a memory card, etc. or through a communication circuit network such as the Internet, etc. Incidentally, when the program product is provided to the user, the program product may be provided to the user in a state in which this program is pre-installed in a hard disk or a memory of the computer system. For example, a computer system mounted in the sheet feeder or another computer capable of making data communication with the sheet feeder can be used as the computer system executing this program.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing unit by friction between the edge of the recording medium and the inclined surface and by friction between the edge of the recording medium and the protrusion member; and a protrusion amount adjusting mechanism configured to adjust a protrusion amount of the protrusion member from the inclined surface, and maintain the protrusion member in a protruded state with respect to the inclined surface when the recording medium is being conveyed, wherein the protrusion amount adjusting mechanism includes:

a variable pressing portion having:

a presser end portion that presses an end portion of the protrusion member in a direction that the protrusion member protrudes from the inclined surface, the end portion being buried in the inclined surface; and a plurality of supported surfaces that is formed at a position opposite to the presser end portion and formed to be different in distance from the presser end portion with each other; and a variable support portion provided with a plurality of support protrusions that face with the supported surfaces and support the variable pressing portion while contacting with any one of the supported surfaces, wherein the protrusion amount adjusting mechanism adjusts the protrusion amount by displacing a relative position between the variable pressing portion and the variable support portion in a direction along the supported surfaces.

2. The sheet feeder according to claim 1 further comprising an operation member that extends from the protrusion amount adjusting mechanism to outside of the sheet feeder for displacing the relative position between the variable pressing portion and the variable support portion in the direction along the supported surfaces.

3. The sheet feeder according to claim 2, wherein the operation member is attached to the variable pressing portion for displacing the variable pressing portion with respect to the variable support portion in the direction along the supported surfaces.

4. The sheet feeder according to claim 2, wherein the operation member is attached to the variable support portion for displacing the variable support portion with respect to the variable pressing portion in the direction along the supported surfaces.

5. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing'unit by friction between the edge of the recording medium and the inclined surface and by friction between the edge of the recording medium and the protrusion member;

a protrusion amount adjusting mechanism configured to adjust a protrusion amount of the protrusion member from the inclined surface, and maintain the protrusion member in a protruded state with respect to the inclined surface when the recording medium is being conveyed; and a controller configured to perform:

counting a number of times in which the feeding of the recording medium by the sheet feeding mechanism is abnormally performed; and notifying a necessity of adjusting the protrusion amount when the number of times counted is equal to or larger than a predetermined threshold value, wherein the controller performs:

notifying the necessity of adjusting the protrusion amount by notifying a message indicating the necessity to a user; and resetting the number of times counted when the protrusion amount is adjusted by the user after the message is notified to the user.

6. The sheet feeder according to claim 5, wherein the controller performs:

counting an idle feed number that indicates a number of times in which the feeding of the recording medium is unperformed regardless of the performing of the sheet feeding mechanism; and notifying a necessity of reducing the protrusion amount when the idle feed number is equal to or larger than a predetermined first threshold value.

7. The sheet feeder according to claim 6, wherein the controller performs:

counting a continuous idle feed number that indicates a number of times in which the feeding of the recording medium is continuously unperformed regardless of repeated performing of the sheet feeding mechanism;

counting an accumulated idle feed number that indicates a number of times in which the feeding of the recording medium is unperformed so far regardless of the performing of the sheet feeding mechanism; and notifying a necessity of reducing the protrusion amount when the continuous idle feed number is equal to or larger than a predetermined second threshold value and the accumulated idle feed number is equal to or larger than a predetermined third threshold value.

8. The sheet feeder according to claim 6, wherein the controller performs:

monitoring the protrusion amount; and notifying that the protrusion amount arrived a lower limit when the idle feed number is equal to or larger than the first threshold value after the protrusion amount arrived the lower limit.

9. The sheet feeder according to claim 5, wherein the controller performs:

counting a multi feed number that indicates a number of times in which a plurality of the recording medium is simultaneously fed by the recording medium; and notifying a necessity of increasing the protrusion amount when the multi feed number is equal to or larger than a predetermined fourth threshold value.

10. The sheet feeder according to claim 9, wherein the controller performs:

monitoring the protrusion amount; and notifying that the protrusion amount arrived a upper limit when the multi feed number is equal to or larger than the fourth threshold value after the protrusion amount arrived the upper limit.

11. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing unit by friction between the edge of the recording medium and the inclined surface and by friction between the edge of the recording medium and the protrusion member;

a protrusion amount adjusting mechanism configured to adjust a protrusion amount of the protrusion member from the inclined surface, and maintain the protrusion member in a protruded state with respect to the inclined surface when the recording medium is being conveyed; and a controller configured to perform:

counting a number of times in which the feeding of the recording medium by the sheet feeding mechanism is abnormally performed; and notifying a necessity of adjusting the protrusion amount when the number of times counted is equal to or larger than a predetermined threshold value, wherein the controller allows to set the threshold value arbitrary in accordance with a command externally input.

12. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing unit by friction between the edge of the recording medium and the inclined surface and by friction between the edge of the recording medium and the protrusion member;

a protrusion amount adjusting mechanism configured to adjust a protrusion amount of the protrusion member from the inclined surface, and maintain the protrusion member in a protruded state with respect to the inclined surface when the recording medium is being conveyed; and a controller configured to perform:

counting a number of times in which the feeding of the recording medium by the sheet feeding mechanism is abnormally performed; and outputting a command to adjust the protrusion amount to the protrusion amount adjusting mechanism when the number of times counted is equal to or larger than a predetermined threshold value, wherein the protrusion amount adjusting mechanism adjusts the protrusion amount in accordance with the command input from the controller, wherein the controller performs resetting the number of times counted when the protrusion amount is adjusted by the protrusion amount adjusting mechanism in accordance with the command.

13. The sheet feeder according to claim 12, wherein the controller performs:

counting an idle feed number that indicates a number of times in which the feeding of the recording medium is unperformed regardless of the performing of the sheet feeding mechanism; and outputting the command to reduce the protrusion amount to the protrusion amount adjusting mechanism when the idle feed number is equal to or larger than a predetermined sixth threshold value.

14. The sheet feeder according to claim 13, wherein the controller performs:

counting a continuous idle feed number that indicates a number of times in which the feeding of the recording medium is continuously unperformed regardless of repeated performing of the sheet feeding mechanism;

counting an accumulated idle feed number that indicates a number of times in which the feeding of the recording medium is unperformed so far regardless of the performing of the sheet feeding mechanism; and outputting the command to reduce the protrusion amount to the protrusion amount adjusting mechanism when the continuous idle feed number is equal to or larger than a predetermined seventh threshold value and the accumulated idle feed number is equal to or larger than a predetermined eighth threshold value.

15. The sheet feeder according to claim 13, wherein the controller performs:

monitoring the protrusion amount; and notifying that the protrusion amount arrived a lower limit when the idle feed number is equal to or larger than the sixth threshold value after the protrusion amount arrived the lower limit.

16. The sheet feeder according to claim 12, wherein the controller performs:

counting a multi feed number that indicates a number of times in which a plurality of the recording medium is simultaneously fed by the recording medium; and outputting the command to increase the protrusion amount to the protrusion amount adjusting mechanism when the multi feed number is equal to or larger than a predetermined ninth threshold value.

17. The sheet feeder according to claim 16, wherein the controller performs:

monitoring the protrusion amount; and notifying that the protrusion amount arrived a upper limit when the multi feed number is equal to or larger than the ninth threshold value after the protrusion amount arrived the upper limit.

18. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing unit by friction between the edge of the recording medium and the inclined surface and by friction between the edge of the recording medium and the protrusion member;

a protrusion amount adjusting mechanism configured to adjust a protrusion amount of the protrusion member from the inclined surface, and maintain the protrusion member in a protruded state with respect to the inclined surface when the recording medium is being conveyed; and a controller configured to perform:

counting a number of times in which the feeding of the recording medium by the sheet feeding mechanism is abnormally performed; and outputting a command to adjust the protrusion amount to the protrusion amount adjusting mechanism when the number of times counted is equal to or larger than a predetermined threshold value, wherein the protrusion amount adjusting mechanism adjusts the protrusion amount in accordance with the command input from the controller, and wherein the controller allows the setting of the threshold value arbitrary in accordance with a command externally input.

19. A sheet feeder comprising:

a storing unit configured to store a plurality of sheets of recording medium;

a retaining unit provided at an edge of the recording medium that is stored in the storing unit, and having an inclined surface that is inclined to a surface of the recording medium and a protrusion member that retains the edge of the recording medium as being protruded from the inclined surface to be in contact with the edge of the recording medium;

a sheet feeding mechanism configured to convey the recording medium stored in the storing unit toward the retaining unit and feed the recording medium while extracting the recording medium one-by-one from the storing unit by friction between the edge of the recording medium and the inclined surface and by friction between the edge of the recording medium and the protrusion member; and a protrusion amount adjusting mechanism configured to adjust a protrusion amount of the protrusion member from the inclined surface, and maintain the protrusion member in a protruded state with respect to the inclined surface when the recording medium is being conveyed, wherein the protrusion amount adjusting mechanism includes:

a variable pressing portion having:

a presser end portion that presses an end portion of the protrusion member in a direction that the protrusion member protrudes from the inclined surface, the end portion buried in the inclined surface; and a supported surface that is formed at a position opposite to the presser end portion; and a variable support portion provided with a plurality of support surfaces formed to be different in distance from the presser end portion with each other, one of the plurality of support surfaces contacting with the supported surface, wherein the protrusion amount adjusting mechanism adjusts the protrusion amount by displacing a relative position between the variable pressing portion and the variable support portion in a direction along the support surfaces.

* * * * *